US011522277B2

(12) United States Patent
Funatsu et al.

(10) Patent No.: US 11,522,277 B2
(45) Date of Patent: Dec. 6, 2022

(54) ANTENNA DEVICE

(71) Applicants: AGC Inc., Tokyo (JP); MAZDA MOTOR CORPORATION, Hiroshima (JP)

(72) Inventors: Toshifumi Funatsu, Tokyo (JP); Satoshi Tokunaga, Tokyo (JP); Shinji Nagamine, Aki-gun (JP); Daiki Mori, Aki-gun (JP); Nobuyuki Shimatani, Aki-gun (JP); Yuuhei Furuse, Aki-gun (JP)

(73) Assignees: AGC INC., Tokyo (JP); MAZDA MOTOR CORPORATION, Hiroshima (JP)

( * ) Notice: Subject to any disclaimer, the term of this patent is extended or adjusted under 35 U.S.C. 154(b) by 79 days.

(21) Appl. No.: 17/208,088

(22) Filed: Mar. 22, 2021

(65) Prior Publication Data

US 2021/0305686 A1 Sep. 30, 2021

(30) Foreign Application Priority Data

Mar. 31, 2020 (JP) ..... JP2020-064830
Apr. 3, 2020 (JP) ..... JP2020-067829

(51) Int. Cl.
*H01Q 1/32* (2006.01)
*H01Q 5/307* (2015.01)
*H01Q 7/00* (2006.01)

(52) U.S. Cl.
CPC ..... *H01Q 1/3275* (2013.01); *H01Q 5/307* (2015.01); *H01Q 7/00* (2013.01)

(58) Field of Classification Search
CPC ..... H01Q 1/3275; H01Q 5/307; H01Q 7/00; H01Q 5/364; H01Q 21/30; H01Q 1/36;
(Continued)

(56) References Cited

U.S. PATENT DOCUMENTS

2004/0217906 A1 11/2004 Ishibayashi et al.
2005/0088344 A1* 4/2005 Saitou ..... H01Q 1/38 343/793

(Continued)

FOREIGN PATENT DOCUMENTS

EP 3 139 440 A 3/2017
JP 2004-128696 A 4/2004

*Primary Examiner* — Dimary S Lopez Cruz
*Assistant Examiner* — Michael M Bouizza
(74) *Attorney, Agent, or Firm* — Foley & Lardner LLP

(57) ABSTRACT

An antenna device includes a power feeding portion; and an antenna including first and second antenna parts, and an amplifier each electrically connected to the power feeding portion. The first antenna part includes a first element including a part extending in a first direction, and a first loop element connected to an end of the first element. The second antenna part includes a second element including a part extending in the first direction, and a second loop element connected to an end of the second element. The first loop element includes a part extending in the first direction, and a part extending in the second direction different from the first direction. The second loop element includes a part extending in the first direction, and a part extending in a third direction opposite to the second direction. The first and second loop elements are positioned apart from each other.

20 Claims, 15 Drawing Sheets

(58) Field of Classification Search
CPC ..... H01Q 1/325; H01Q 1/38; H01Q 1/50; H01Q 5/10; H01Q 5/28
See application file for complete search history.

(56) References Cited

U.S. PATENT DOCUMENTS

| | | | | |
|---|---|---|---|---|
| 2007/0069964 | A1* | 3/2007 | Hoshiai | H01Q 1/1271 343/700 MS |
| 2009/0160717 | A1* | 6/2009 | Tsutsumi | H01Q 19/30 343/726 |
| 2017/0069960 | A1 | 3/2017 | Funatsu et al. | |

* cited by examiner

| ■FM | | LENGTH $W_{FM}$ [mm] | | | | | | | | |
|---|---|---|---|---|---|---|---|---|---|---|
| | | 200 | 250 | 300 | 350 | 400 | 450 | 500 | 550 | 600 |
| HEIGHT $H_{FM}$ [mm] | 0 | −11.1 | −9.5 | −8.5 | −8.5 | −9.1 | −10.1 | −11.2 | −12.4 | −13.6 |
| | 10 | −11.7 | −10.4 | −9.3 | −8.6 | −8.6 | −9.0 | −9.8 | −11.1 | −12.2 |
| | 30 | −12.6 | −11.2 | −9.9 | −9.0 | −8.7 | −9.0 | −9.7 | −10.6 | −11.9 |
| | 50 | −13.2 | −11.8 | −10.6 | −9.6 | −9.1 | −9.2 | −9.7 | −10.5 | −11.6 |
| | 90 | −13.9 | −12.8 | −11.6 | −10.5 | −9.9 | −9.9 | −10.2 | −11.0 | −11.9 |
| | 110 | −14.2 | −13.2 | −11.9 | −10.9 | −10.3 | −10.3 | −10.5 | −11.3 | −12.2 |

| ■DAB | | LENGTH $W_{FM}$ [mm] | | | | | | | | |
|---|---|---|---|---|---|---|---|---|---|---|
| | | 200 | 250 | 300 | 350 | 400 | 450 | 500 | 550 | 600 |
| HEIGHT $H_{FM}$ [mm] | 0 | −12.5 | −12.3 | −12.3 | −12.2 | −12.2 | −12.5 | −12.3 | −12.0 | −11.6 |
| | 10 | −12.5 | −12.4 | −12.3 | −12.2 | −12.2 | −12.3 | −12.7 | −12.2 | −11.9 |
| | 30 | −12.6 | −12.4 | −12.3 | −12.2 | −12.2 | −12.4 | −12.8 | −12.3 | −12.2 |
| | 50 | −12.7 | −12.4 | −12.3 | −12.2 | −12.2 | −12.2 | −12.9 | −12.6 | −12.5 |
| | 90 | −12.7 | −12.5 | −12.4 | −12.2 | −12.2 | −12.3 | −13.1 | −13.0 | −12.9 |
| | 110 | −12.6 | −12.6 | −12.3 | −12.1 | −12.2 | −12.5 | −13.4 | −13.4 | −13.0 |

ASPECT RATIO OF FM LOOP RANGE: 3.18 ~50.0

| $H_{FM}$ \ $W_{FM}$ | 200 | 250 | 300 | 350 | 400 | 450 | 500 | 550 | 600 |
|---|---|---|---|---|---|---|---|---|---|
| 0 | | | | | | | | | |
| 10 | 20.00 | 25.00 | 30.00 | 35.00 | 40.00 | 45.00 | 50.00 | 55.00 | 60.00 |
| 30 | 6.67 | 8.33 | 10.00 | 11.67 | 13.33 | 15.00 | 16.67 | 18.33 | 20.00 |
| 50 | 4.00 | 5.00 | 6.00 | 7.00 | 8.00 | 9.00 | 10.00 | 11.00 | 12.00 |
| 90 | 2.22 | 2.78 | 3.33 | 3.89 | 4.44 | 5.00 | 5.56 | 6.11 | 6.67 |
| 110 | 1.82 | 2.27 | 2.73 | 3.18 | 3.64 | 4.09 | 4.55 | 5.00 | 5.45 |

| ■FM | | LENGTH $W_{DAB}$ [mm] | | | | | | | | | | |
|---|---|---|---|---|---|---|---|---|---|---|---|---|
| | | 100 | 125 | 150 | 175 | 200 | 225 | 250 | 275 | 300 | 325 | 350 |
| HEIGHT $H_{DAB}$ [mm] | 0 | −10.1 | −10.0 | −9.9 | −9.7 | −9.6 | −9.5 | −9.4 | −9.3 | −9.2 | −9.1 | −9.0 |
| | 10 | −10.0 | −9.8 | −9.7 | −9.6 | −9.4 | −9.3 | −9.2 | −9.1 | −9.0 | −8.9 | −8.8 |
| | 30 | −10.0 | −9.9 | −9.7 | −9.6 | −9.5 | −9.4 | −9.3 | −9.2 | −9.2 | −9.1 | −9.1 |
| | 50 | −10.0 | −9.9 | −9.8 | −9.7 | −9.6 | −9.5 | −9.4 | −9.4 | −9.3 | −9.3 | −9.3 |
| | 70 | −10.0 | −9.9 | −9.8 | −9.7 | −9.6 | −9.6 | −9.5 | −9.5 | −9.5 | −9.5 | −9.5 |
| | 90 | −10.1 | −10.0 | −9.9 | −9.8 | −9.8 | −9.7 | −9.7 | −9.7 | −9.7 | −9.7 | −9.8 |
| | 110 | −10.1 | −10.1 | −10.0 | −10.0 | −9.9 | −9.9 | −9.9 | −9.9 | −9.9 | −10.0 | −10.0 |

| ■DAB | | LENGTH $W_{DAB}$ [mm] | | | | | | | | | | |
|---|---|---|---|---|---|---|---|---|---|---|---|---|
| | | 100 | 125 | 150 | 175 | 200 | 225 | 250 | 275 | 300 | 325 | 350 |
| HEIGHT $H_{DAB}$ [mm] | 0 | −16.0 | −14.1 | −13.2 | −12.5 | −12.0 | −12.5 | −13.3 | −14.2 | −14.8 | −15.4 | −15.8 |
| | 10 | −13.8 | −13.1 | −12.1 | −11.9 | −12.7 | −13.4 | −14.0 | −14.5 | −15.0 | −15.3 | −15.7 |
| | 30 | −13.3 | −12.5 | −12.1 | −12.7 | −13.4 | −14.0 | −14.5 | −15.0 | −15.3 | −15.7 | −16.0 |
| | 50 | −13.2 | −12.6 | −12.4 | −13.0 | −13.7 | −14.3 | −14.8 | −15.3 | −15.6 | −15.9 | −16.3 |
| | 70 | −13.2 | −12.9 | −12.9 | −13.5 | −14.1 | −14.7 | −15.2 | −15.7 | −16.0 | −16.4 | −16.7 |
| | 90 | −13.4 | −13.2 | −13.4 | −14.0 | −14.7 | −15.1 | −15.6 | −16.0 | −16.4 | −16.7 | −17.0 |
| | 110 | −13.7 | −13.8 | −14.1 | −14.6 | −15.2 | −15.6 | −16.0 | −16.4 | −16.7 | −16.9 | −17.2 |

ASPECT RATIO OF DAB LOOP RANGE: 0.91 ~25.0

| $H_{DAB}$ \ $W_{DAB}$ | 100.0 | 125.0 | 150.0 | 175.0 | 200.0 | 225.0 | 250.0 | 275.0 | 300.0 | 325.0 | 350.0 |
|---|---|---|---|---|---|---|---|---|---|---|---|
| 0 | | | | | | | | | | | |
| 10 | 10.00 | 12.50 | 15.00 | 17.50 | 20.00 | 22.50 | 25.00 | 27.50 | 30.00 | 32.50 | 35.00 |
| 30 | 3.33 | 4.17 | 5.00 | 5.83 | 6.67 | 7.50 | 8.33 | 9.17 | 10.00 | 10.83 | 11.67 |
| 50 | 2.00 | 2.50 | 3.00 | 3.50 | 4.00 | 4.50 | 5.00 | 5.50 | 6.00 | 6.50 | 7.00 |
| 70 | 1.43 | 1.79 | 2.14 | 2.50 | 2.86 | 3.21 | 3.57 | 3.93 | 4.29 | 4.64 | 5.00 |
| 90 | 1.11 | 1.39 | 1.67 | 1.94 | 2.22 | 2.50 | 2.78 | 3.06 | 3.33 | 3.61 | 3.89 |
| 110 | 0.91 | 1.14 | 1.36 | 1.59 | 1.82 | 2.05 | 2.27 | 2.50 | 2.73 | 2.95 | 3.18 |

ANTENNA DEVICE

CROSS-REFERENCE TO RELATED APPLICATIONS

The present application is based upon and claims the benefit of priority to Japanese Patent Application No. 2020-064830 filed on Mar. 31, 2020, and Japanese Patent Application No. 2020-067829 filed on Apr. 3, 2020, the entire contents of which are hereby incorporated by reference.

BACKGROUND OF THE INVENTION

1. Field of the Invention

The present disclosure relates to an antenna device.

2. Description of the Related Art

In recent years, as an antenna device installed in a vehicle such as an automobile, an antenna device that has composite antenna elements aggregated to be capable of receiving signals in multiple frequency bands, such as AM broadcasting waves, FM broadcasting waves, digital terrestrial television broadcasting waves, radio waves of DAB (Digital Audio Broadcasting), and the like, has been put into practical use. For example, an antenna device that includes multiple antenna elements inside an air spoiler having an outer panel formed of synthetic resin, to receive multiple radio waves in different frequency bands (FM broadcasting waves, AM broadcasting waves, TV broadcasting waves, and the like), has been known (see, for example, Japanese Laid-Open Patent Application No. 2004-128696).

However, conventional antenna devices do not necessarily have satisfactory reception performance for radio waves in these multiple frequency bands.

SUMMARY OF THE INVENTION

The present disclosure provides an antenna device that is installed in a vehicle component attached to a vehicle body, to receive radio waves in a first frequency band, radio waves in a second frequency band, and radio waves in a third frequency band. The antenna device includes a power feeding portion;

an antenna including a first antenna portion electrically connected to the power feeding portion, and a second antenna portion electrically connected to the power feeding portion;

an amplifier electrically connected to the power feeding portion, wherein the first antenna portion comprises a first element including a part extending in a first direction, and a first loop element having a loop-shaped outer edge and being connected to an end of the first element on an opposite side with respect to the power feeding portion, wherein the second antenna portion comprises a second element including a part extending in a first direction, and a second loop element having a loop-shaped outer edge and being connected to an end of the second element on an opposite side with respect to the power feeding portion, wherein the first loop element includes a part extending in the first direction, and a part extending in a second direction that is different from the first direction, wherein the second loop element includes a part extending in the first direction, and a part extending in a third direction opposite to the second direction, and wherein the first loop element and the second loop element are positioned apart from each other.

DESCRIPTION OF THE PREFERRED EMBODIMENTS

Figure 1:
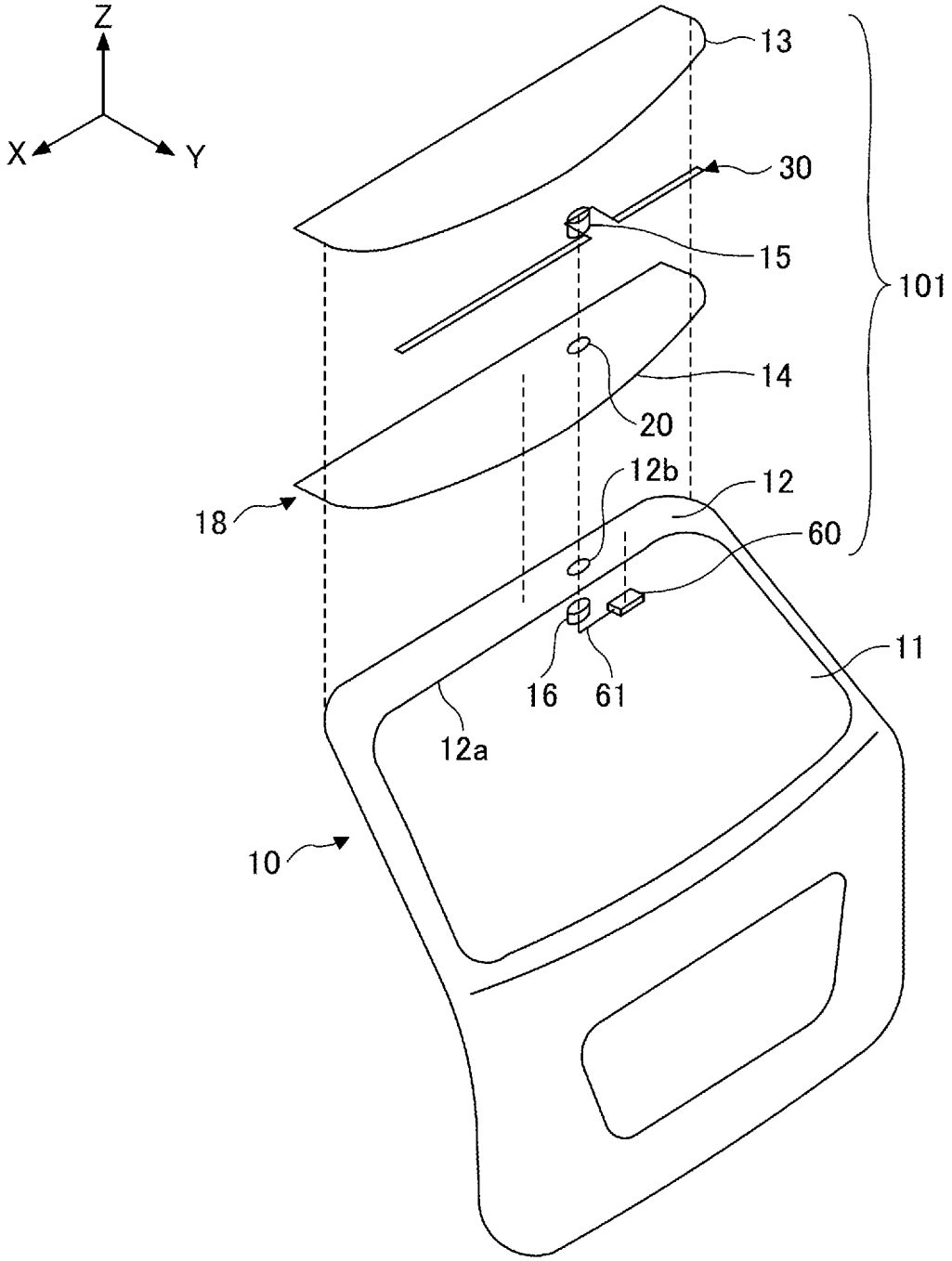
FIG. 1 is an exploded perspective view exemplifying a vehicle component in which an antenna device is installed, and a vehicle body to which the vehicle component is attached, according to one embodiment.

In the following, with reference to the drawings, an embodiment according to the present disclosure will be described. Note that for ease of understanding, the scale of parts in the drawings may differ from a scale of actual cases. A direction as described being parallel, perpendicular, orthogonal, horizontal, vertical, longitudinal, lateral, and so forth, is assumed to have deviation to an extent not impairing effects of embodiments. The shape of the corners is not limited to the right angle and may be rounded in arcs. The X-axis direction, Y-axis direction, and Z-axis direction represent a direction parallel to the X-axis, a direction parallel to the Y-axis, and a direction parallel to the Z-axis, respectively. The X-axis direction, the Y-axis direction, and the Z-axis direction are orthogonal to each other. The XY-plane, YZ-plane, and ZX-plane represent a virtual plane parallel to the X-axis direction and the Y-axis direction, a virtual plane parallel to the Y-axis direction and the Z-axis direction, and a virtual plane parallel to the Z-axis direction and the X-axis direction, respectively.

FIG. 1 is an exploded perspective view exemplifying a vehicle component in which an antenna device is installed, and a vehicle body to which the vehicle component is attached, according to one embodiment. An antenna device 101 illustrated in FIG. 1 is an example of an antenna device provided in a vehicle component attached to a vehicle body. FIG. 1 illustrates an example in which the antenna device 101 is installed in a spoiler 18 that is attached to a liftgate 10 as part of the vehicle body. The lift gate 10 is an openable/closable door attached to the rear of the vehicle body, to which a window glass 11 is attached. The spoiler 18 is an example of a vehicle component, and is a component made of resin to be secured to an upper part of the liftgate 10. The spoiler 18 has an inner cover 14 and an outer cover 13. The antenna device 101 is provided with a water-proof connector 16, an antenna 30, and an amplifier 60.

The water-proof connector 16 is an example of a power feeding portion for feeding power to the antenna 30, and is electrically connected to the antenna 30. The water-proof connector 16 is connected to an input terminal of the amplifier 60 via a cable 61 (wire). The water-proof connector 16 is attached to, for example, an antenna outlet 12*b* formed in a metal part 12 of the vehicle body. The antenna outlet 12*b* is an opening formed on a surface of the metal part 12 on the vehicle exterior side.

The antenna 30 is a conductor that receives radio waves in at least three different frequency bands, and in this example, part of the antenna 30 is arranged inside the spoiler 18 in a state being held between the inner cover 14 and the outer cover 13. The antenna 30 may be built in the spoiler 18, or may be provided on the outer surface of the spoiler 18. The antenna 30 is a linearly formed conductive member, and may be formed of, for example, a conductive wire, a conductive paint, a metal rod, a metal plate, or the like.

The amplifier 60 has an input terminal electrically connected to the water-proof connector 16, to amplify a signal received by the antenna 30. The signal amplified by the amplifier 60 is fed to a receiving device or the like (not illustrated) that is installed in the vehicle body. In this example, the amplifier 60 is attached to the upper part of the liftgate 10.

Figure 2:
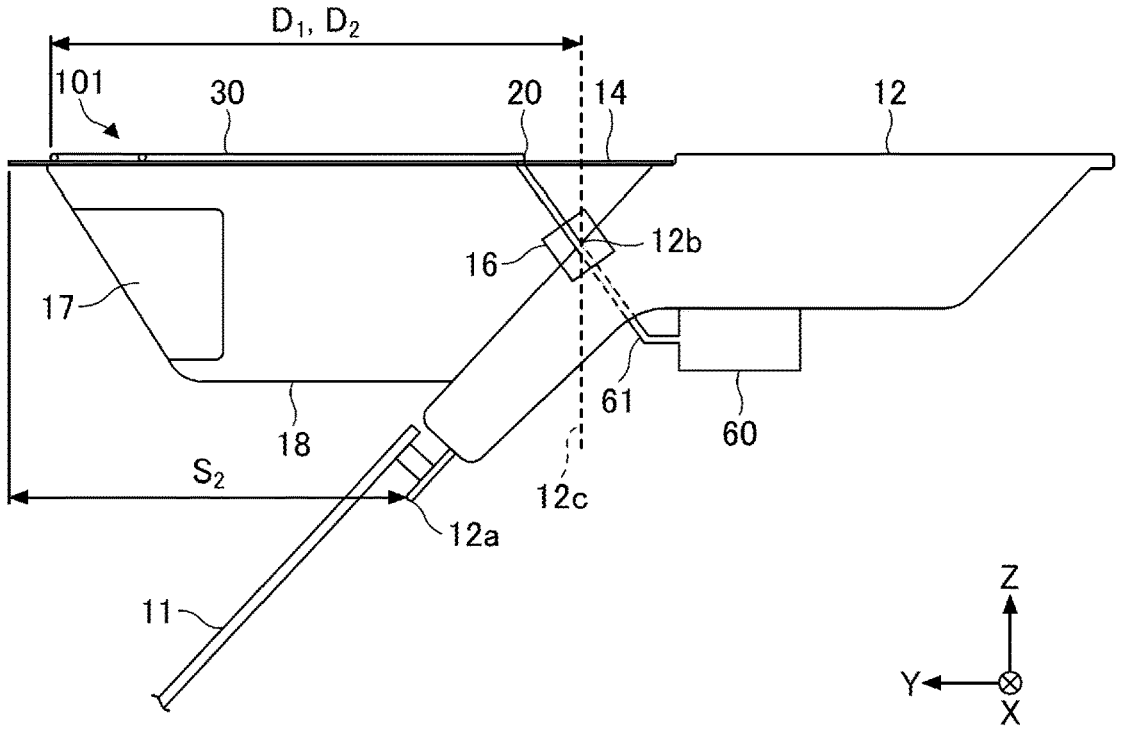
FIG. 2 is a cross sectional view exemplifying a vehicle component in which an antenna device is installed, and a vehicle body to which the vehicle component is attached, according to one embodiment.

FIG. 2 is a cross sectional view exemplifying a vehicle component in which an antenna device is installed, and a vehicle body to which the vehicle component is attached, according to one embodiment. The spoiler 18 may have a high mount stop lamp 17 installed. In the case where the spoiler 18 has a high mount stop lamp 17 installed, by arranging the antenna 30 above the high mount stop lamp 17, reduction in the reception sensitivity of the antenna 30 can be suppressed. Also, from the viewpoint of suppressing the reduction in the reception sensitivity of the antenna 30, it is favorable to arrange the antenna 30 so as not to cross wires connected to the high mounted stop lamp 17. In FIG. 2, illustration of the outer cover 13 is omitted.

A location where the antenna 30 is formed or attached to may be the inner cover 14 or the outer cover 13 (not illustrated) being a dielectric, or a dielectric substrate (not illustrated) secured to the inner cover 14 or the outer cover 13. By having the antenna 30 formed on the dielectric substrate, it becomes easy to attach the antenna 30 to the spoiler 18. The dielectric substrate may be a printed circuit board, a flexible circuit board, or the like.

An element of the antenna 30 passes through a hole 20 formed in the inner cover 14, to be connected to the water-proof connector 16 that is attached to the antenna outlet 12*b* of the metal part 12 of the vehicle body. Also, a virtual plane 12*c* is defined as the ZX plane that passes through the antenna outlet 12*b*, and is orthogonal to the Y-axis direction. The virtual plane 12*c* will be described in detail with the antenna 30 illustrated in FIG. 4.

Figure 3:
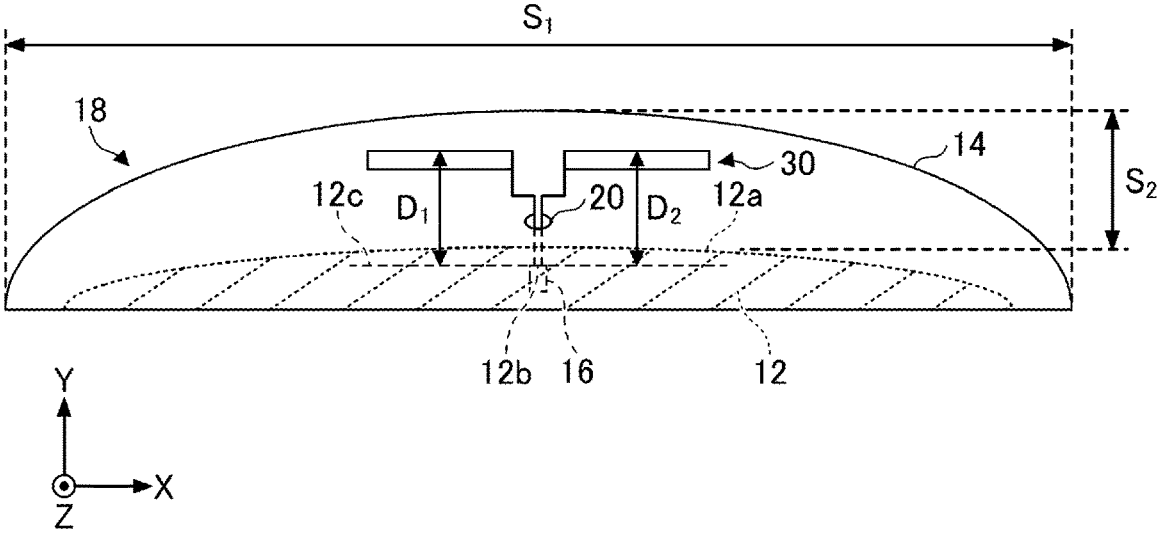
FIG. 3 is a plan view exemplifying a vehicle component in which an antenna device is installed, and a vehicle body to which the vehicle component is attached, according to one embodiment.

FIG. 3 is a plan view exemplifying a vehicle component in which an antenna device is installed, and a vehicle body to which the vehicle component is attached, according to one embodiment; specifically, this is a diagram as viewed from a viewpoint above the vehicle. In this example, as viewed in the direction (in this example, the Z-axis direction) normal to the horizontal plane (in this example, the XY-plane) in a state where the spoiler 18 is attached to the vehicle body, the antenna 30 intersects an edge 12*a* of the metal part 12 of the vehicle body. The metal part 12 is, for example, an upper part of the liftgate 10. In the example illustrated in FIGS. 2 and 3, the metal part 12 is a flange to which a windowpane 11 is attached, and the edge 12*a* is an end of the flange.

By having the antenna 30 and the edge 12*a* intersect in this way as viewed in the Z-axis direction, part of the antenna 30 does not overlap the metal part 12 as viewed in the Z-axis direction. This allows the antenna 30 to be formed to have a non-overlapping part (part within a width $S_2$) with the metal part 12 in the Z-axis direction, and thereby, the reduction in the reception sensitivity of the antenna 30 can be suppressed. The width $S_2$ is a distance from the edge 12*a* to the far end of spoiler 18 in the Y-axis direction. The width $S_1$ is a width in the width direction of the spoiler 18. Note that as viewed in the Z-axis direction, the antenna 30 does not need to intersect the edge 12*a*. As forms of the antenna 30 not intersecting the edge 12*a*, there are a form in which the entirety of the antenna 30 overlaps the metal part 12 in the Z-axis direction, and a form in which the entirety of the antenna 30 does not overlap the metal part 12 in the Z-axis direction.

Figure 4:
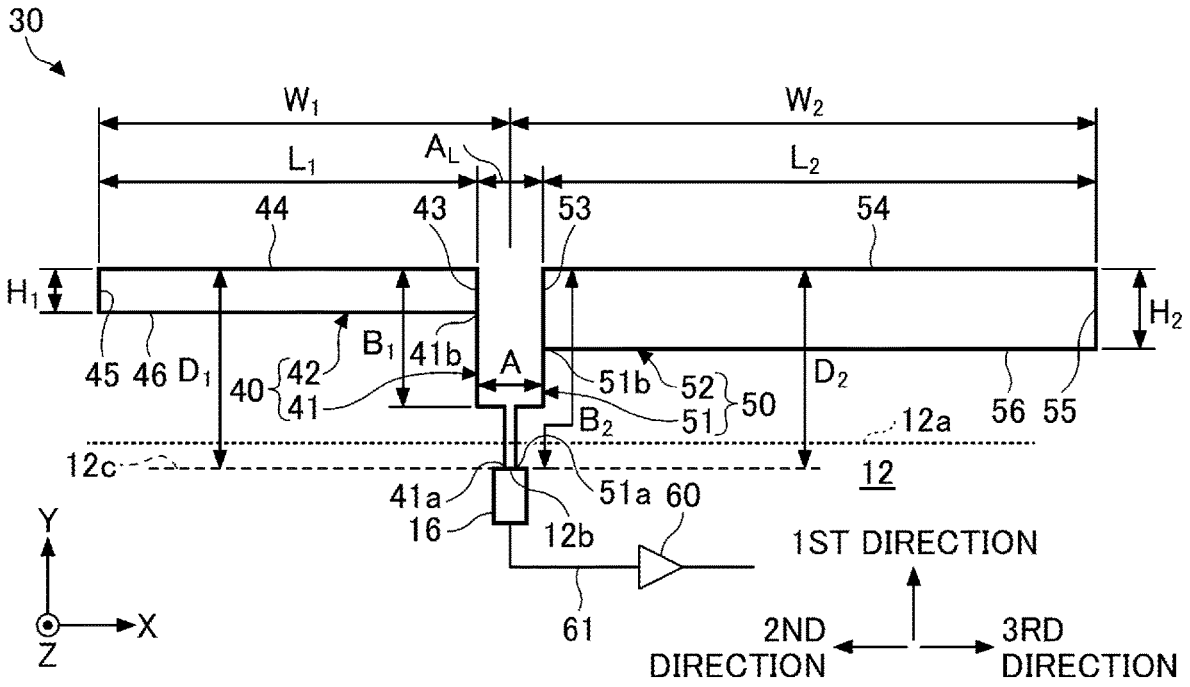
FIG. 4 is a plan view illustrating a first configuration example of an antenna according to one embodiment.

FIG. 4 is a plan view illustrating a first configuration example of an antenna according to one embodiment. The antenna 30 illustrated in FIG. 4 is configured to be capable of receiving radio waves in a first frequency band, radio waves in a second frequency band, and radio waves in a third frequency band, and resonates at a frequency in each frequency band higher than or equal to at least the VHF band.

For example, the first frequency band corresponds to the MF (Medium Frequency) band including frequencies of 300 kHz to 3 MHz, and the second frequency band and the third frequency band correspond to the VHF (Very High Frequency) band including frequencies of 30 MHz to 300 MHz. In this case, the first frequency band may be set to a band of AM broadcasting waves included in the MF band; the second frequency band may be set to a band of FM broadcasting waves included in the VHF band; and the third frequency band may be set to a band of Band III of the DAB included in the VHF band.

The antenna 30 may further be famed to be capable of receiving radio waves in a fourth frequency band, and in this case, resonates at a frequency in the fourth frequency band. For example, the fourth frequency band corresponds to the Ultra High Frequency (UHF) band covering frequencies of 300 MHz to 3 GHz. In this case, the fourth frequency band may be set to a band of digital terrestrial television broadcasting waves ranging 470 MHz to 720 MHz included within the UHF band.

The antenna 30 includes a first antenna portion 40 and a second antenna portion 50. The first antenna portion 40 is an antenna element electrically connected to the water-proof connector 16, and the second antenna portion 50 is an antenna element electrically connected to the water-proof connector 16. The first antenna portion 40 includes a first element 41 and a first loop element 42, and the second antenna portion 50 includes a second element 51 and a second loop element 52. Note that the "electrically connected" configuration includes not only a configuration in which the first antenna portion 40 and the second antenna portion 50 are directly connected to the water-proof connector 16 as illustrated in FIG. 4, but also a configuration of wireless connection at a radiofrequency.

The first element 41 is a conductor that includes a part extending in the first direction. In this example, the first element 41 includes an end 41*a* connected to the water-proof connector 16 and an end 41*b* on the opposite side with respect to the water-proof connector 16, and includes at least one bent part (two in the case of FIG. 4) between the end 41*a* and the end 41*b*.

The first loop element 42 is a conductor that has a looped outer edge, and is connected to the end 41*b* of the first element 41 on the opposite side with respect to the water-proof connector 16. The first loop element 42 includes parts 43 and 45 extending in the first direction, and parts 44 and 46 extending in a second direction that is different from the first direction. In this example, the parts 43 and 45 are opposite to each other in the X-axis direction, and the parts 44 and 46 are opposite to each other in the Y-axis direction.

The second element 51 is a conductor that includes a part extending in the first direction. In this example, the second element 51 includes an end 51*a* connected to the water-proof connector 16 and an end 51*b* on the opposite side with respect to the water-proof connector 16, and includes at least one bent part (two in the case of FIG. 4) between the end 51*a* and the end 51*b*. Note that the "bent part" is not limited to parts of the first element 41 and the second element 51 being bent to form right angles as illustrated in FIG. 4, and may be a part at which the direction of extension is changed, for example, a portion included in a curve at which the radius of curvature is minimum.

The second loop element 52 is a conductor that has a looped outer edge, and is connected to the end 51*b* of the first element 51 on the opposite side with respect to the water-proof connector 16. The second loop element 52 includes parts 53 and 55 extending in the first direction and parts 54 and 56 extending in the third direction opposite to the second direction. In this example, the parts 53 and 55 are opposite to each other in the X-axis direction, and the parts 54 and 56 are opposite to each other in the Y-axis direction.

The first loop element 42 and the second loop element 52 are positioned apart from each other, and in this example, arranged apart in the X-axis direction so as to provide spacing between the part 43 and the part 53. By arranging the first loop element 42 and the second loop element 52 apart from each other, an antenna 30 can receive radio waves in at least three different frequency bands with high sensitivity, with a simple configuration.

In the example illustrated in FIG. 4, the first direction is a direction extending away from the metal part 12 of the vehicle body as viewed in the Z-axis direction. As viewed in the direction normal to the horizontal plane in a state where the vehicle component in which the antenna device 101 is installed is attached to the vehicle body, the first element 41 and the second element 51 intersect the edge 12*a* of the metal part 12. By providing such intersections, part of the antenna 30 does not overlap the metal part 12 in the Z-axis direction; therefore, the reduction in the reception sensitivity of the antenna 30 can be suppressed.

The first element 41 and the second element 51 are connected to different connection points (specifically, terminals) in the water-proof connector 16. The first element 41 is connected to the water-proof connector 16 at the end 41*a*, and the second element 51 is connected to the water-proof connector 16 at the end 51*a*. The first element 41 and the second element 51 are connected to the common water-proof connector 16 at the connection points different from each other; therefore, the first element 41 and the second element 51 can be independently connected to the common water-proof connector 16. In particular, in the case where the first element 41 and the second element 51 are constituted with wires such as AV lines, work of connecting the first element 41 and the second element 51 to the water-proof connector 16 becomes easy.

In this example, as the first direction is substantially orthogonal to the second direction and the third direction, the reception sensitivity of the antenna 30 is likely to be improved. Here, "substantially orthogonal" may include orthogonal. In this example, the first direction is parallel to the positive Y-axis direction; the second direction is parallel to the negative X-axis direction; and the third direction is parallel to the positive X-axis direction.

In this example, the outer end of the first loop element 42 is famed to be substantially a rectangle; therefore, the reception sensitivity of the antenna 30 is likely to be improved. Here, "substantially a rectangle" covers, for example, a shape having a curve in at least one of the four edges and the four corners of a rectangle. Note that the first loop element 42 can suppress reduction of the reception sensitivity even if the outer edge has a looped shape that is different from substantially a rectangle. In this example, the outer end of the second loop element 52 is formed to be substantially a rectangle, too; therefore, the reception sensitivity of the antenna 30 is likely to be improved. The second loop element 52 can suppress reduction of the reception sensitivity even if the outer edge has a looped shape that is different from substantially a rectangle.

In this example, the first element 41 and the first loop element 42 have respective parts extending in the first direction on a straight line parallel to the first direction; therefore, the reception sensitivity of the antenna 30 is likely to be improved. In the example illustrated in FIG. 4, the first element 41 has a part extending on an extension line of the part 43 of the first loop element 42. Similarly, the second element 51 and the second loop element 52 have respective parts extending in the first direction on a straight line parallel to the first direction; therefore, the reception sensitivity of the antenna 30 is likely to be improved. In the example illustrated in FIG. 4, the second element 51 has a part extending on an extension line of the part 53 of the second loop element 52.

If the first antenna part 40 and the second antenna part 50 are conductors formed on a dielectric substrate such as a printed circuit board (not illustrated), then, work of attaching the antenna 30 to the vehicle component such as the spoiler 18 described above becomes easier. Also, in the case where the first loop element 42 and the second loop element 52 of the antenna 30 are famed to be substantially rectangles, if the direction of the longer sides of each rectangle extends in the X-axis direction (the vehicle width direction), it is favorable because when installing the antenna 30 in the spoiler 18, the antenna 30 can be effectively arranged in a space of the spoiler 18.

Figure 5:
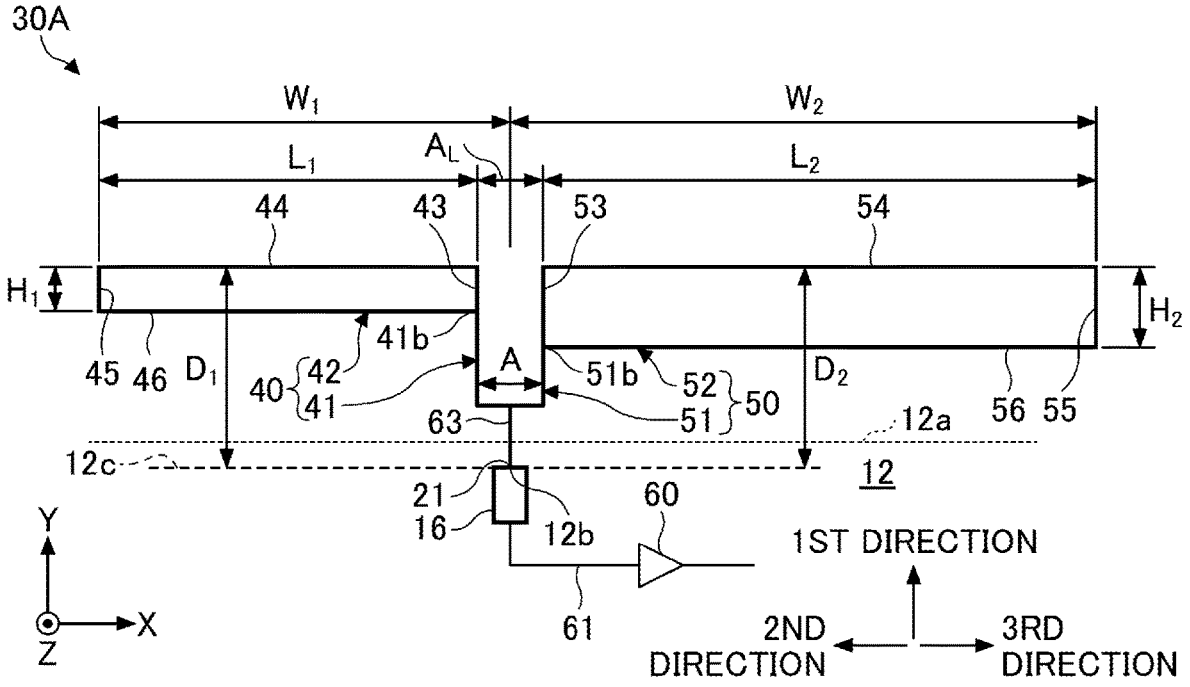
FIG. 5 is a plan view illustrating a second configuration example of an antenna according to one embodiment.

FIG. 5 is a plan view illustrating a second configuration example of an antenna according to one embodiment. Description for those elements substantially the same as in the first configuration example described above is omitted by reference to the above description. An antenna 30A illustrated in FIG. 5 has a shape different from that of the antenna 30 (FIG. 4) at a portion connecting the first element 41 and the second element 51 with the water-proof connector 16.

In the antenna 30A, the first element 41 and the second element 51 are connected to a common connection point 21 (specifically, a terminal) of the water-proof connector 16 via a shared connection element 63. The first element 41 and the second element 51 share the connection element 63 extending from the common connection point 21, and branch off from the connection element 63, to extend separately. As part of the first element 41 and part of the second element 51 are common, the antenna 30A can receive radio waves in at least three different frequency bands with high sensitivity, with a simple configuration.

Figure 6:
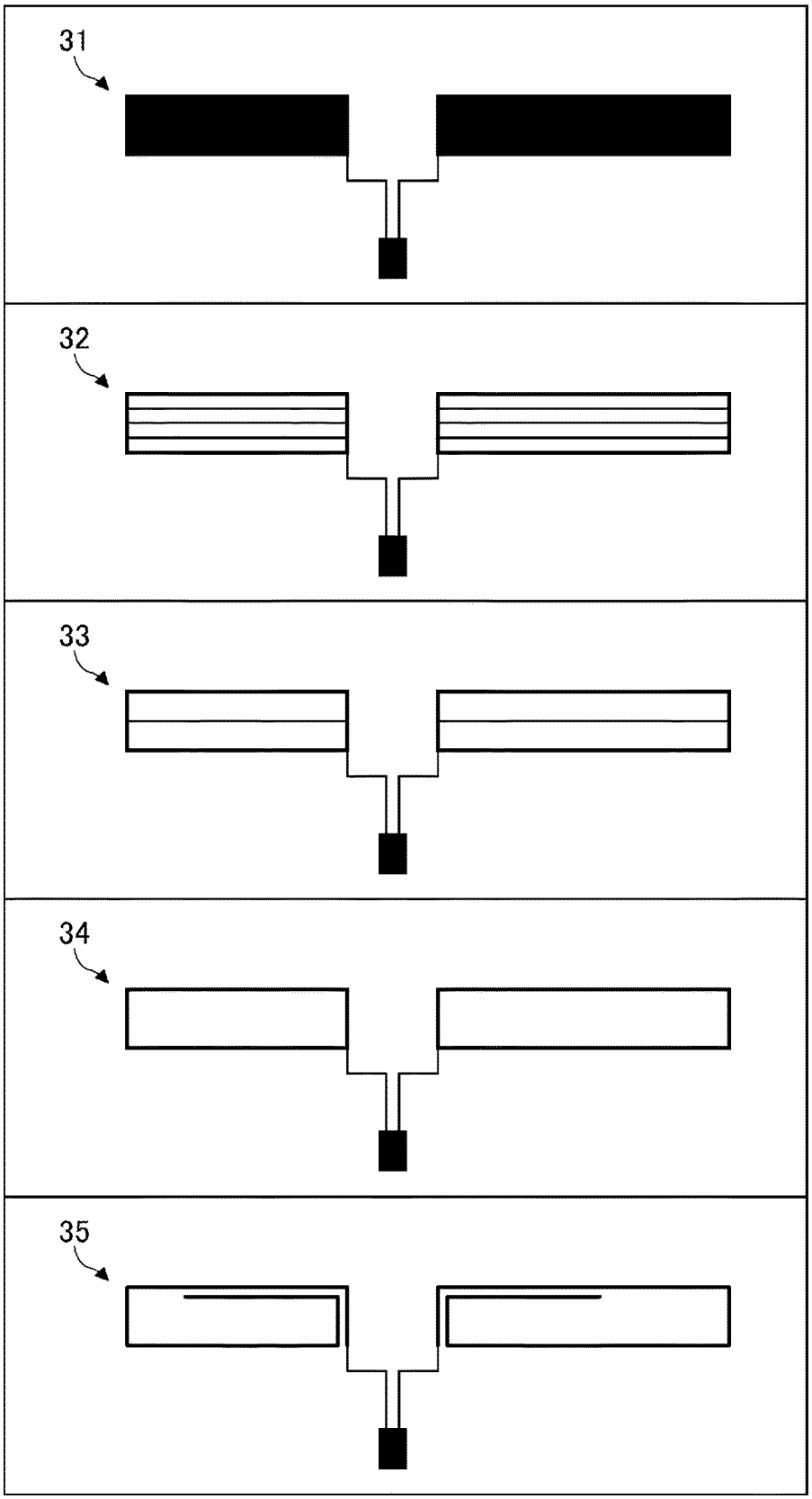
FIG. 6 is a plan view illustrating third to seventh configuration examples of antennas according to one embodiment.

FIG. 6 is a plan view illustrating third to seventh configuration examples of antennas according to one embodiment. Description for those elements substantially the same as in the first and second configuration examples described above is omitted by reference to the above description. Although antennas 31 to 35 illustrated in FIG. 6 have shapes different from that of the antenna 30 (FIG. 4) in the first loop element 42 and the second loop element 52, these antennas can receive radio waves in at least three different frequency bands with high sensitivity, with a simple configuration.

The antenna 31 has a first loop element 42 and a second loop element 52 in each of which a solid conductor occupies the inside of the outer edge. The antenna 32 has a first loop element 42 and a second loop element 52 in each of which four closed loops are formed by three elements that extend in the X-axis direction. The antenna 33 has a first loop element 22 and a second loop element 52 in each of which two closed loops are formed by one element that extend in the X-axis direction. The antenna 34 has a first loop element 42 and a second loop element 52 each forming one closed loop. The antenna 35 has a first loop element 42 and a second loop element 52 each forming one open loop in which a capacitive coupling is generated along parallel segments one of which is closer to the end of the open loop, to form a pseudo-closed loop.

Next, by taking the antenna 30 illustrated in FIG. 4 as an example, antenna capacitance and received voltage of the antenna 30 will be described. A virtual plane 12*c* is defined as a virtual plane that passes through the antenna outlet 12*b* (water-proof connector 16) famed on the surface of the metal part 12, and is orthogonal to the first direction.

Denoting a distance from the virtual plane 12*c* to the end of the first antenna portion 40 on the first direction side by $D_1$ [mm], a distance from the virtual plane 12*c* to the end of the second antenna portion 50 on the first direction side by $D_2$ [mm], a maximum width of the first loop element 42 in the first direction by $H_1$ [mm], a maximum width of the first loop element 42 in the second direction by $L_1$ [mm], a maximum width of the second loop element 52 in the first direction by $H_2$ [mm], a maximum width of the second loop element 52 in the third direction by $L_2$ [mm], spacing between the first loop element 42 and the second loop element 52 by $A_L$ [mm], $L_1+A_L/2$ by $W_1$ [mm], $L_2+A_L/2$ by $W_2$ [mm], an antenna capacitance of the antenna 30 by $C_a$ [pF], an antenna capacitance of the first antenna portion 40 by $C_{a1}$ [pF], an antenna capacitance of the second antenna portion 50 by $C_{a2}$ [pF], a received voltage of the first antenna portion 40 by $V_{a1}$ [dBμ$V_{emf}$], a received voltage of the second antenna portion 50 by $V_{a2}$ [dBμ$V_{emf}$], and a received voltage of the antenna 30 by $V_a$ [dBμ$V_{emf}$], and setting $k_1=1.02\times10^{-4}$, $k_2=7.97\times10^{-5}$, $k_3=2.61\times10^{-2}$, $k_4=1.77\times10^{-2}$, $k_5=9.83\times10^{-4}$, $k_6=2.87\times10^{-1}$, $l_1=3.29\times10^{-2}$, $l_2=6.99\times10^{-2}$, and $l_3=2.76\times10^{1}$, The following relationships are satisfied:

$$C_{a1}=(k_1\cdot H_1-k_2\cdot D_1+k_3)\cdot W_1+k_4\cdot H_1+k_5\cdot D_1+k_6 \quad \text{[Formula 1]}$$

$$C_{a2}=(k_1\cdot H_1-k_2\cdot D_1+k_3)\cdot W_2+k_4\cdot H_2+k_5\cdot D_2+k_6$$

$$C_a=C_{a1}+C_{a2}$$

$$V_{a1}=-l_1\cdot H_1+l_2\cdot D_1+l_3$$

$$V_{a2}=-l_1\cdot H_2+l_2\cdot D_2+l_3$$

$$V_a=20\log_{10}\left\{\left(10^{\frac{V_{a1}}{20}}-10^{\frac{V_{a2}}{20}}\right)\cdot\frac{C_{a1}}{C_{a1}+C_{a2}}+10^{\frac{V_{a2}}{20}}\right\}$$

Here, denoting a voltage of the input terminal of the amplifier 60 by $V_i$ [dBμ$V_{emf}$], and a load capacitance from the water-proof connector 16 to the amplifier 60 by $C_i$ [pF], the following relationship is satisfied:

$$V_i=20\log_{10}\left(\frac{C_a}{C_a+C_i}\cdot10^{\frac{V_a}{20}}\right) \quad \text{[Formula 2]}$$

At this time, if the voltage $V_i$ [dBμ$V_{emf}$] that appears at the input terminal of the amplifier 60 satisfies the following inequalities, $$15\ [\text{dB}\mu V_{emf}]\le V_i\le35\ [\text{dB}\mu V_{emf}] \quad \text{[Formula 3]}$$

then, the antenna 30 has no problem in terms of receiving the AM broadcasting waves with high sensitivity. Note that the band of the AM broadcasting waves ranges from 530 kHz to 1720 kHz.

More favorably, if the voltage $V_i$ [dBμ$V_{emf}$] that appears at the input terminal of the amplifier 60 satisfies the following inequalities, $$20\ [\text{dB}\mu V_{emf}]\le V_i\le30\ [\text{dB}\mu V_{emf}] \quad \text{[Formula 4]}$$

then, the antenna 30 has no problem in terms of receiving the AM broadcasting waves with high sensitivity.

As for the water-proof connector 16 and the amplifier 60, although a form of direct connection may be considered, a form of connection via the cable 61 can be also considered. In the case where the antenna device 101 includes the cable 61 connecting the water-proof connector 16 with the amplifier 60, the load capacitance $C_i$ [pF] described above may be the sum of the input capacitance $C_{AMP}$ [pF] of the amplifier 60 and the capacitance $C_{cb}$ of the cable 61.

Figure 7:
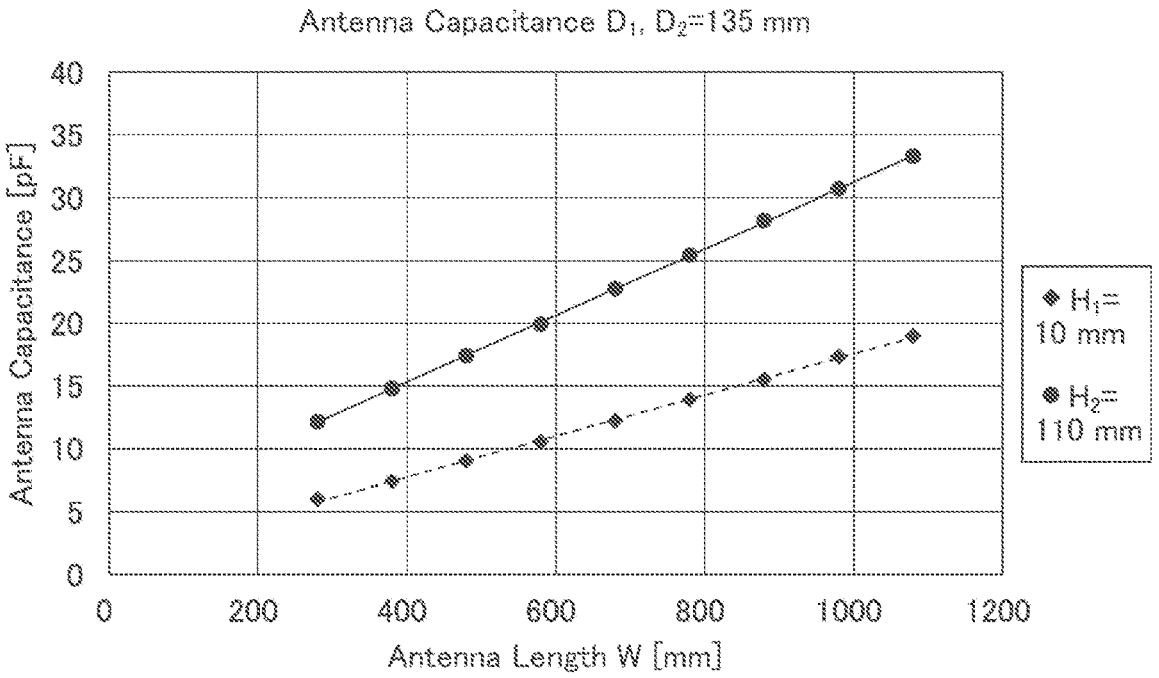
FIG. 7 is a graph exemplifying relationships between the antenna capacitance $C_a$ and the antenna widths (lengths) $W_1$ and $W_2$ of an antenna, in the case where the maximum widths (heights) $H_1$ and $H_2$ are 10 mm and 110 mm, respectively, and the distances $D_1$ and $D_2$ are fixed to 135 mm.
Figure 8:
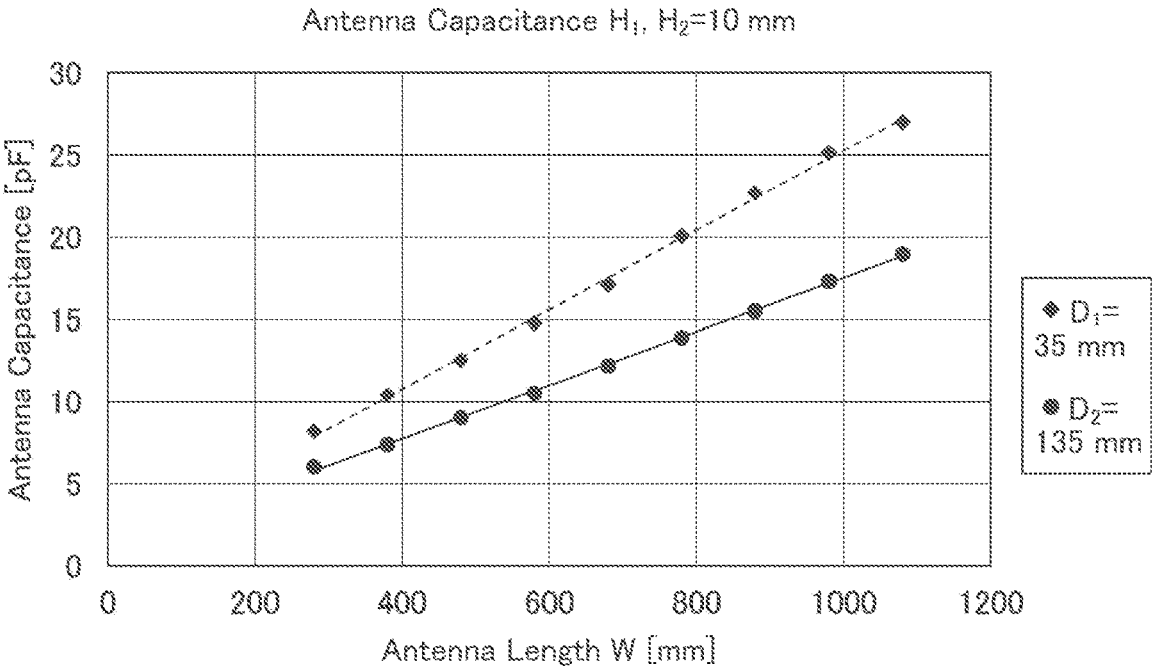
FIG. 8 is a graph exemplifying relationships between the antenna capacitance $C_a$ and the antenna widths $W_1$ and $W_2$ of an antenna, in the case where the distances $D_1$ and $D_2$ are 35 mm and 135 mm, respectively, and the maximum widths $H_1$ and $H_2$ are fixed to 10 mm.
Figure 9:
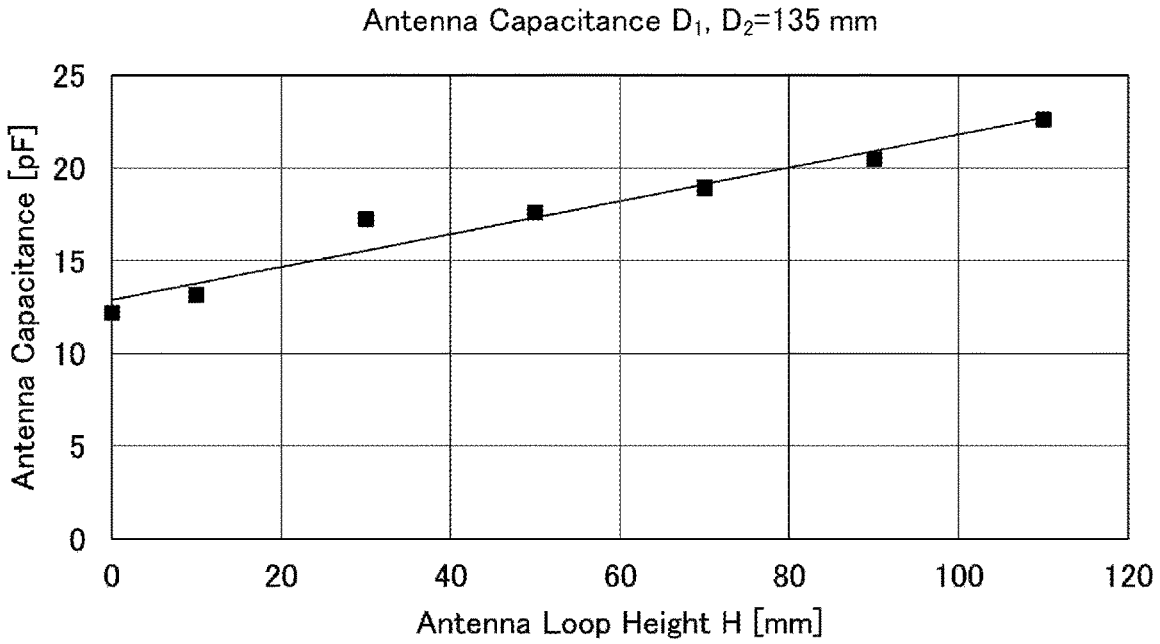
FIG. 9 includes a graph exemplifying a relationship between the antenna capacitance $C_a$ and the maximum widths $H_1$ and $H_2$ of an antenna, in the case where the distances $D_1$ and $D_2$ are fixed to 135 mm.
Figure 10:
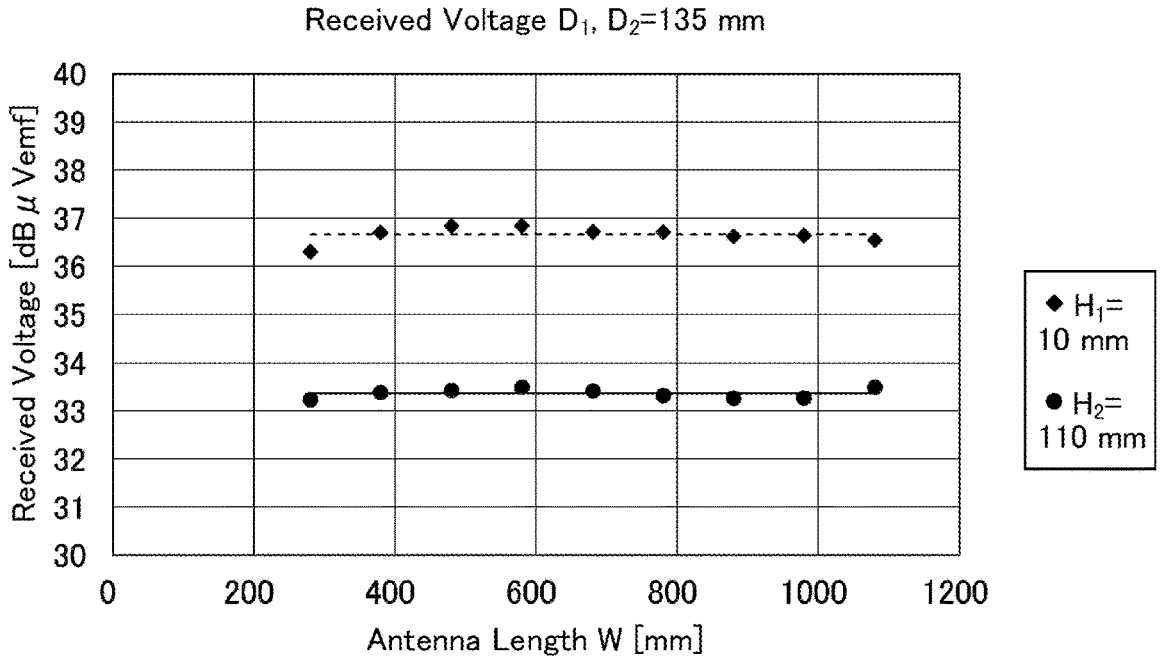
FIG. 10 is a graph exemplifying relationships between the received voltage and the antenna widths $W_1$ and $W_2$ of an antenna 30, in the case where the maximum widths $H_1$ and $H_2$ are 10 mm and 110 mm, respectively, and the distances $D_1$ and $D_2$ are fixed to 135 mm.
Figure 11:
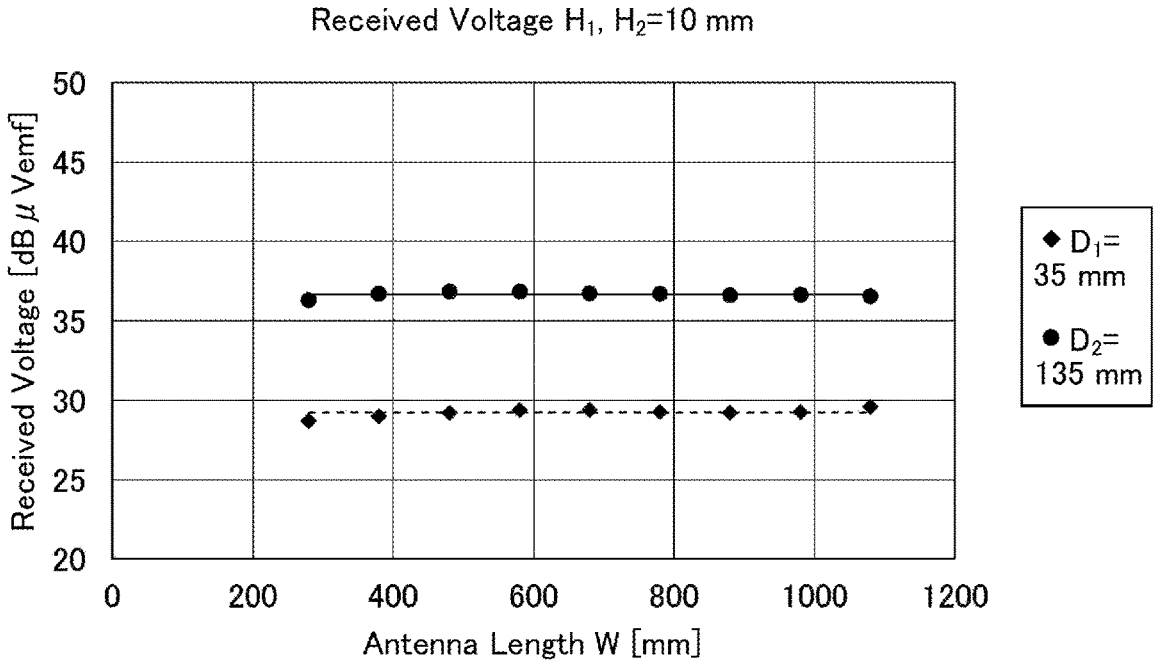
FIG. 11 is a graph exemplifying relationships between the received voltage and the antenna widths $W_1$ and $W_2$ of an antenna 30, in the cases where the distances $D_1$ and $D_2$ are 35 mm and 135 mm, respectively, and the maximum widths $H_1$ and $H_2$ are fixed to 10 mm.
Figure 12:
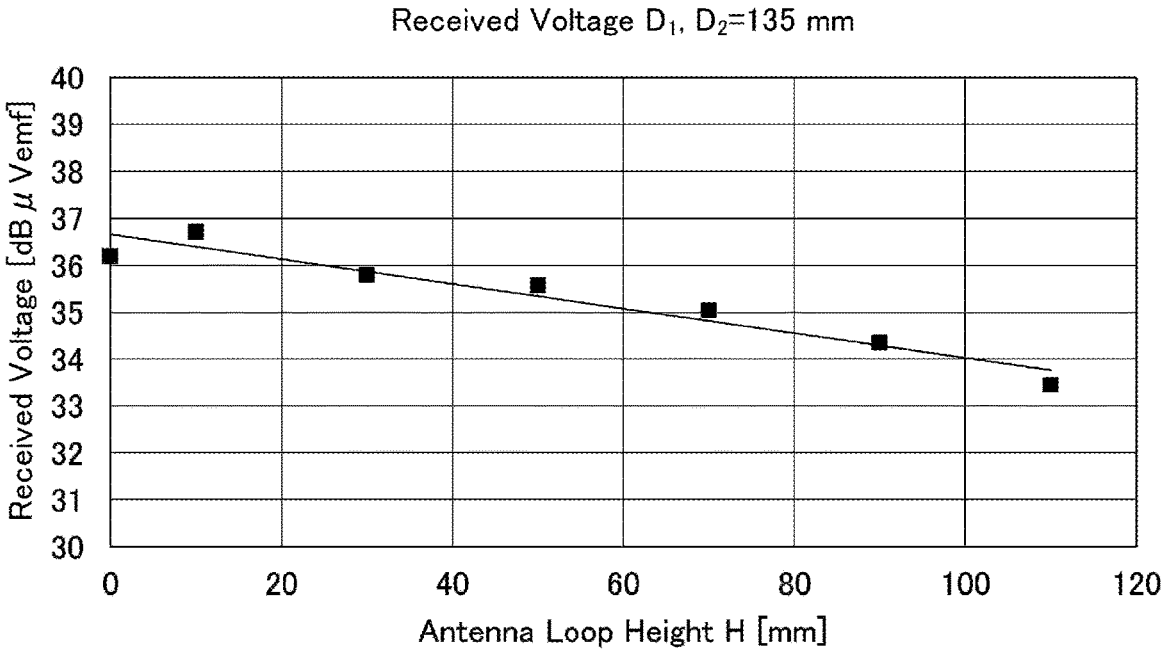
FIG. 12 includes a graph exemplifying a relationship between the received voltage and the maximum widths $H_1$ and $H_2$ of the antenna 30, in the case where the distances $D_1$ and $D_2$ are fixed to 135 mm.

Note that the calculation formulas of the antenna capacitances $C_{a1}$ and $C_{a2}$ and the coefficients $k_1$ to $k_6$ therein expressed as above are derived from graphs in FIGS. 7 to 9; and the calculation formulas of the received voltages $V_{a1}$ and $V_{a2}$ and the coefficients $l_1$ to $l_3$ therein expressed as above are derived from the graphs in FIGS. 10 to 12.

FIG. 7 is a graph exemplifying relationships between the antenna capacitance $C_a$ of the antenna 30 and the antenna widths (lengths) $W_1$ and $W_2$, in the case where the maximum widths (heights) $H_1$ and $H_2$ are 10 mm and 110 mm, respectively, and the distances $D_1$ and $D_2$ are fixed to 135 mm. In both cases, as the antenna widths $W_1$ and $W_2$ become longer, the antenna capacitance $C_a$ becomes greater. FIG. 8 is a graph exemplifying relationships between the antenna capacitance $C_a$ of the antenna 30 and the antenna widths $W_1$ and $W_2$, in the case where the distances $D_1$ and $D_2$ are 35 mm and 135 mm, respectively, and the maximum widths $H_1$ and $H_2$ are fixed to 10 mm. In both cases, as the antenna widths $W_1$ and $W_2$ become longer, the antenna capacitance $C_a$ becomes greater. FIG. 9 includes a graph exemplifying a relationship between the antenna capacitance $C_a$ of the antenna 30 and the maximum widths $H_1$ and $H_2$, in the case where the distances $D_1$ and $D_2$ are fixed to 135 mm. Regression equations derived from points on the graph in FIG. 9 correspond to the calculation formulas for the antenna capacitances $C_{a1}$ and $C_{a2}$ described above.

FIG. 10 is a graph exemplifying relationships between the received voltage and the antenna widths $W_1$ and $W_2$ of the antenna 30, in the cases where the maximum widths $H_1$ and $H_2$ are 10 mm and 110 mm, respectively, and the distances $D_1$ and $D_2$ are fixed to 135 mm. In both cases, the received voltage $V_a$ is virtually not dependent on the antenna widths $W_1$ and $W_2$. FIG. 11 is a graph exemplifying relationships between the received voltage and the antenna widths $W_1$ and $W_2$ of the antenna 30, in the cases where the distances $D_1$ and $D_2$ are 35 mm and 135 mm, respectively, and the maximum widths $H_1$ and $H_2$ are fixed to 10 mm. In both cases, the received voltage $V_a$ is virtually not dependent on the antenna widths $W_1$ and $W_2$. FIG. 12 includes a graph exemplifying a relationship between the received voltage and the maximum widths $H_1$ and $H_2$ of the antenna 30, in the case where the distances $D_1$ and $D_2$ are fixed to 135 mm. Regression equations derived from points on the graph in FIG. 12 correspond to the calculation formulas for the received voltages $V_{a1}$ and $V_{a2}$ described above. Note that the received voltage of the antenna 30 [dBμ$V_{emf}$] in each of FIGS. 10 to 12 is an average in the band of AM broadcasting waves.

In the antenna according to the present disclosure in FIG. 4 and the like, denoting $L_1+L_2+A_L$ by W, and setting 50 [mm]≤W≤1500 [mm], setting 10 [mm]≤$H_1$≤300 [mm], setting 10 [mm]≤$H_2$≤300 [mm], setting 15 [mm]≤$D_1$≤300 [mm], and setting 15 [mm]≤$D_2$≤300 [mm], radio waves in the MF band can be received with high sensitivity. Note that the band of FM broadcasting waves ranges from 88 MHz to 108 MHz, and Band III of the DAB ranges from 170 MHz to 240 MHz.

By setting 95 [mm]≤$D_1$≤300 [mm], and setting 95 [mm]≤$D_2$≤300 [mm], the antenna gain of the FM broadcasting waves is improved, and hence, the FM broadcasting waves can be received with higher sensitivity.

By setting 115 [mm]≤W≤300 [mm], and setting 115 [mm]≤$D_2$≤300 [mm], the antenna gain of the FM broadcasting waves is improved, and the antenna gain of Band III of the DAB is improved, and hence, the FM broadcasting waves and the radio waves in Band III of the DAB can be received with even higher sensitivity.

In the antenna according to the present disclosure in FIG. 4 and the like, from the viewpoint of receiving radio waves in the VHF band with high sensitivity, although it is favorable that $D_1$ is the same as $D_2$, these may be different.

In the antenna according to the present disclosure in FIG. 4 and the like, from the viewpoint of receiving radio waves in the VHF band with high sensitivity, although it is favorable that $H_1$ is the same as $H_2$, these may be different.

In the antenna according to the present disclosure in FIG. 4 and the like, from the viewpoint of receiving the FM broadcasting waves with high sensitivity, the maximum width $L_1$ is favorably 3.18 times or greater and 50 times or smaller with respect to the maximum width $H_1$, and more favorably 4.44 times or greater and 45 times or smaller with respect to the maximum width $H_1$.

In the antenna according to the present disclosure in FIG. 4 and the like, from the viewpoint of receiving radio waves in Band III of the DAB with high sensitivity, the maximum width $L_2$ is favorably 0.91 times or greater and 25 times or smaller with respect to the maximum width $H_2$, and more favorably 1.79 times or greater and 20 times or smaller with respect to the maximum width $H_2$.

In the antenna according to the present disclosure in FIG. 4 and the like, from the viewpoint of receiving the FM broadcasting waves with high sensitivity, 250 [mm]$\leq L_1 \leq$550 [mm] is favorable, and 250 [mm]$\leq L_1 \leq$500 [mm] is more favorable. In the antenna according to the present disclosure in FIG. 4 and the like, from the viewpoint of receiving radio waves in Band III of the DAB with high sensitivity, 100 [mm]$\leq L_2 \leq$250 [mm] is favorable, and 125 [mm]$\leq L_2 \leq$225 [mm] is more favorable.

In the antenna according to the present disclosure in FIG. 4 and the like, from the viewpoint of receiving the FM broadcasting waves and radio waves in Band III of the DAB with high sensitivity, 0 [mm]$\leq A_L \leq$240 [mm] is favorable, and 2 [mm]$\leq A_L \leq$240 [mm] is more favorable.

In the antenna according to the present disclosure in FIG. 4 and the like, denoting spacing between the first element 41 and the second element 51 by A, from the viewpoint of receiving the FM broadcasting waves and radio waves in Band III of the DAB with high sensitivity, 0 [mm]$<A\leq$240 [mm] is favorable, and 2 [mm]$\leq A \leq$240 is more favorable.

Figures 13, 14:
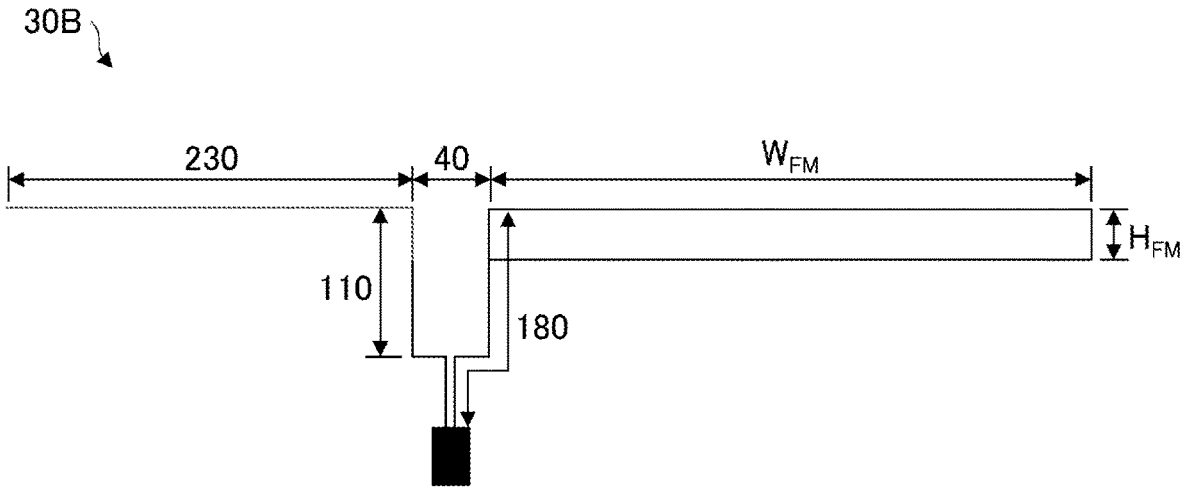
FIG. 13 is a plan view illustrating an antenna part contributing to reception of radio waves in the VHF band, in an antenna according to one embodiment.
FIG. 14 illustrates an example of measurement results of average antenna gains in the band of FM broadcasting waves when changing the height $H_{FM}$ and the length $W_{FM}$ of an antenna including the antenna part in FIG. 13.
Figures 15, 16:
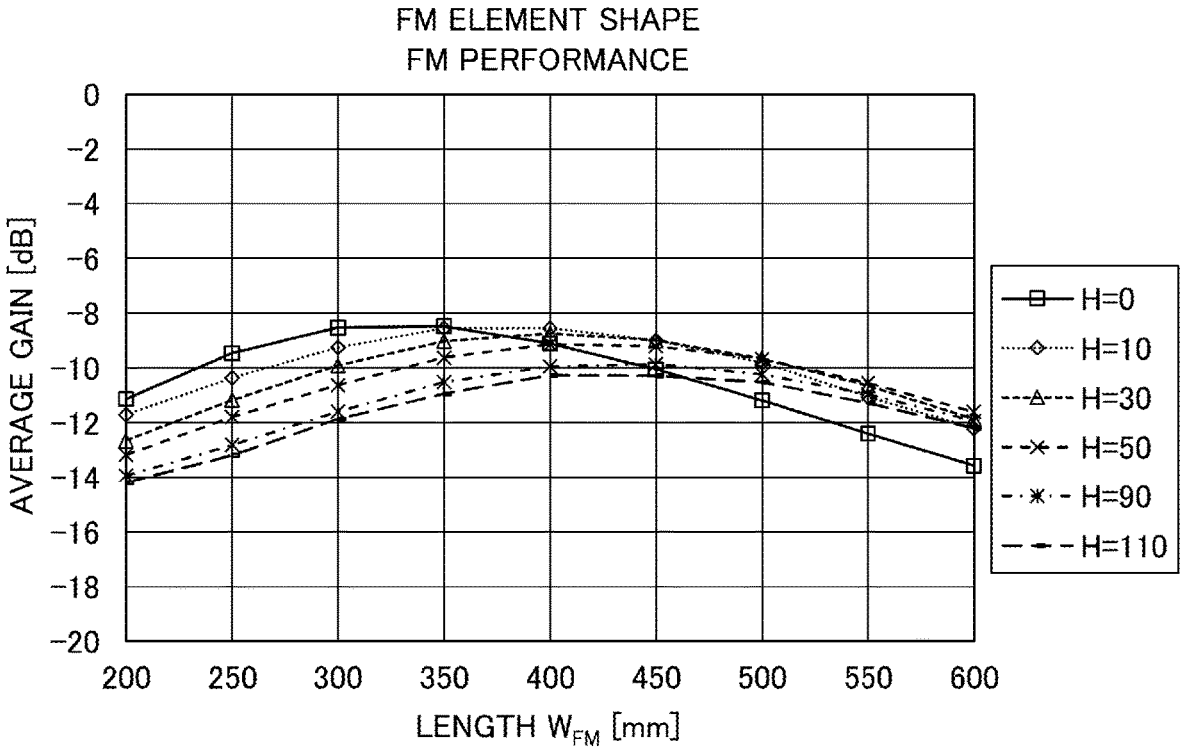
FIG. 15 illustrates an example of measurement results of average antenna gains in Band III of the DAB when changing the height $H_{FM}$ and the length $W_{FM}$ of the antenna including the antenna part in FIG. 13.
FIG. 16 is a graph showing the measurement results in FIG. 14.
Figures 17, 18:
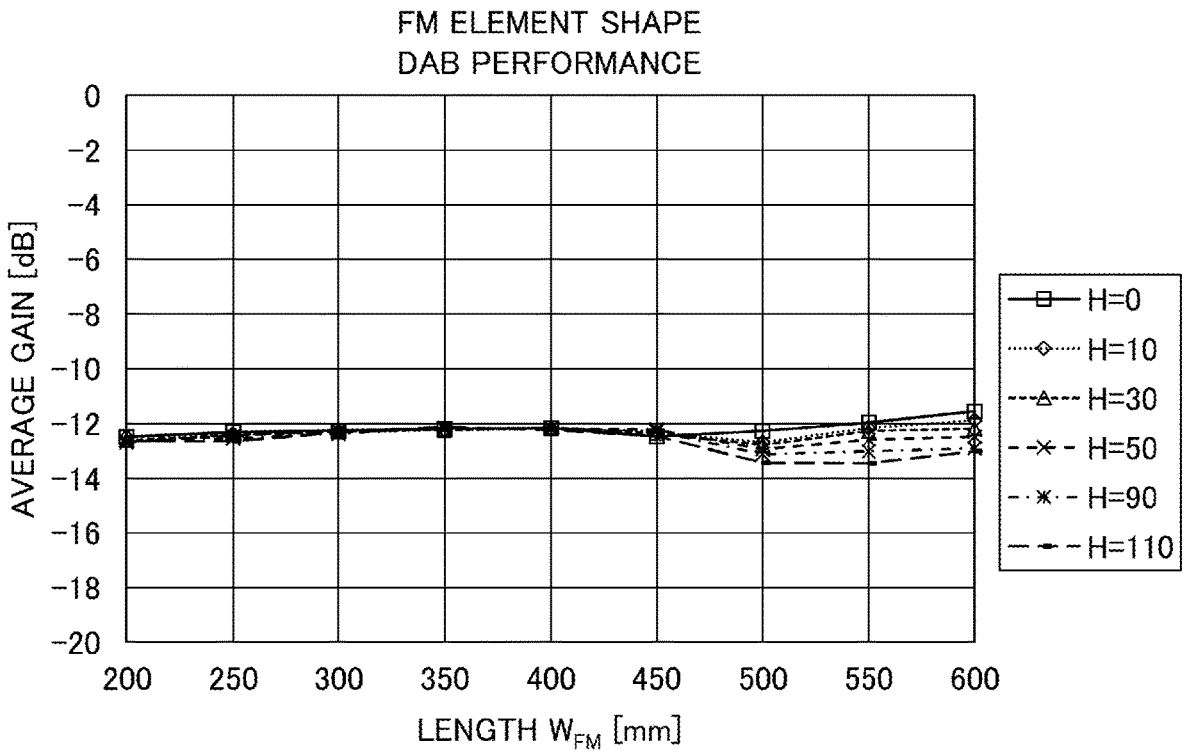
FIG. 17 is a graph showing the measurement results in FIG. 15.
FIG. 18 illustrates an example of measurement results of average antenna gains in the band of FM broadcasting waves when changing the aspect ratio of the antenna including the antenna part in FIG. 13.

FIG. 13 is a plan view illustrating an antenna part 30B contributing to reception of radio waves in the VHF band in the antenna 30. Numerical values in FIG. 13 designate lengths [mm] of corresponding elements. FIG. 14 illustrates an example of measurement results of average antenna gains with respect to vertical polarization in the band of FM broadcasting waves when changing the height $H_{FM}$ and the length $W_{FM}$ of the antenna 30 including the antenna part 30B. FIG. 15 illustrates an example of measurement results of average antenna gains with respect to vertical polarization in Band III of the DAB when changing the height $H_{FM}$ and the length $W_{FM}$ of the antenna 30 including the antenna part 30B. FIG. 16 is a graph showing the measurement results in FIG. 14. FIG. 17 is a graph showing the measurement results in FIG. 15. Note that a height $H_{FM}$=0 corresponds to a pattern in which no loop is provided in the antenna part 30B in FIG. 13.

According to FIGS. 14 to 17, in the case where the height $H_{FM}$ and the length $W_{FM}$ of the antenna part 30B were adjusted, although the average antenna gain in the band of FM broadcasting waves changed significantly, the average antenna gain in Band III of the DAB did not change significantly.

Ranges within which values greater than or equal to a threshold of "−11 dB" that enables the antenna to receive the FM broadcasting waves with relatively high sensitivity, were obtained as follows:

$$110\ [\text{mm}] \geq H_F \geq 10\ [\text{mm}]$$

$$550\ [\text{mm}] \geq W_{FM} \geq 250\ [\text{mm}]$$

Ranges within which values greater than or equal to a threshold of "−10 dB" that enables the antenna to receive the FM broadcasting waves with relatively high sensitivity, were obtained as follows:

$$90\ [\text{mm}] \geq H_{FM} \geq 10\ [\text{mm}]$$

$$500\ [\text{mm}] \geq W_{FM} \geq 250\ [\text{mm}]$$

FIG. 18 illustrates an example of measurement results of average antenna gains in the band of FM broadcasting waves when changing the aspect ratio of the antenna 30 including the antenna part 30B. The antenna gain was greater than or equal to the threshold of "−11 dB" for aspect ratios obtained from cells patterned with dots. The antenna gain was greater than or equal to the threshold of "−10 dB" for aspect ratios obtained from cells patterned with oblique lines.

Figures 19, 20:
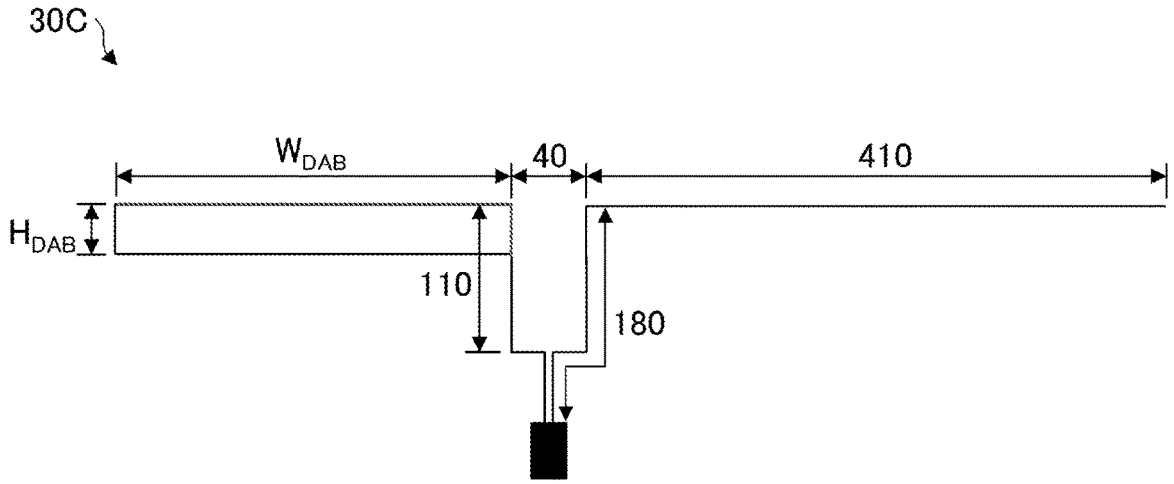
FIG. 19 is a plan view illustrating an antenna part contributing to reception of radio waves in Band III of the DAB, in an antenna according to one embodiment.
FIG. 20 illustrates an example of measurement results of average antenna gains in the band of FM broadcasting waves when changing the height $H_{DAB}$ and the length $W_{DAB}$ of an antenna including the antenna part in FIG. 19.
Figures 21, 22:
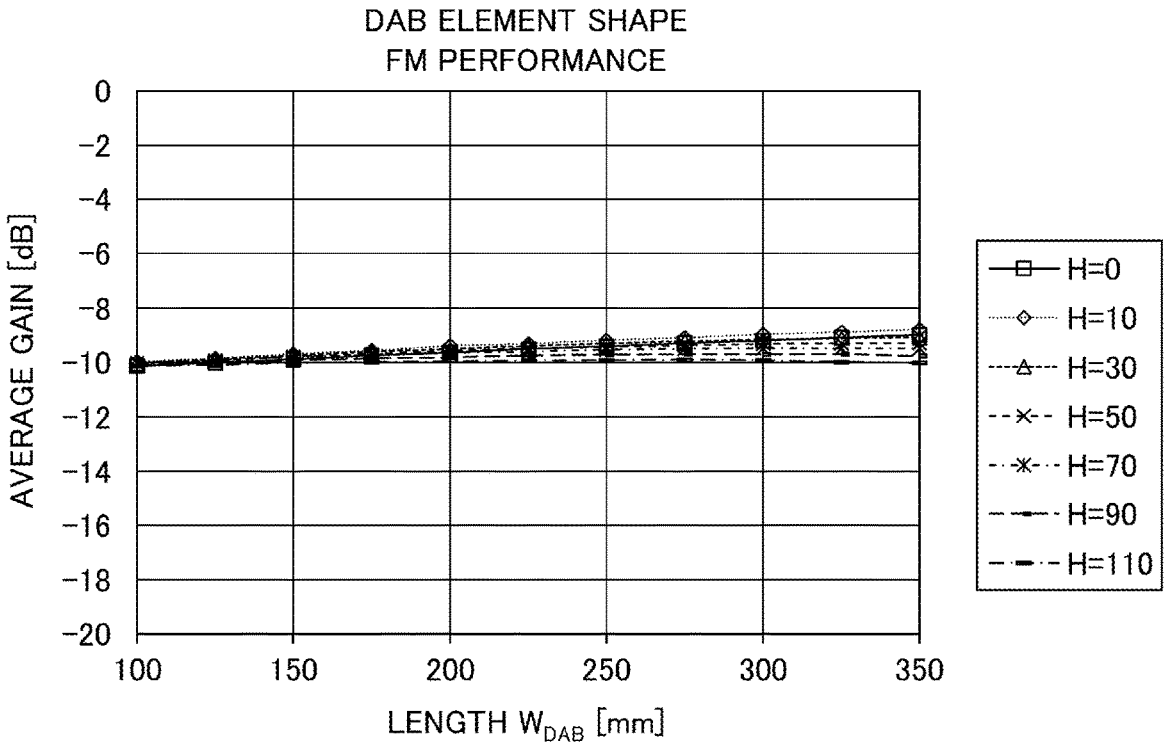
FIG. 21 illustrates an example of measurement results of average antenna gains in Band III of the DAB when changing the height $H_{DAB}$ and the length $W_{DAB}$ of the antenna including the antenna part in FIG. 19.
FIG. 22 is a graph showing the measurement results in FIG. 20.
Figures 23, 24:
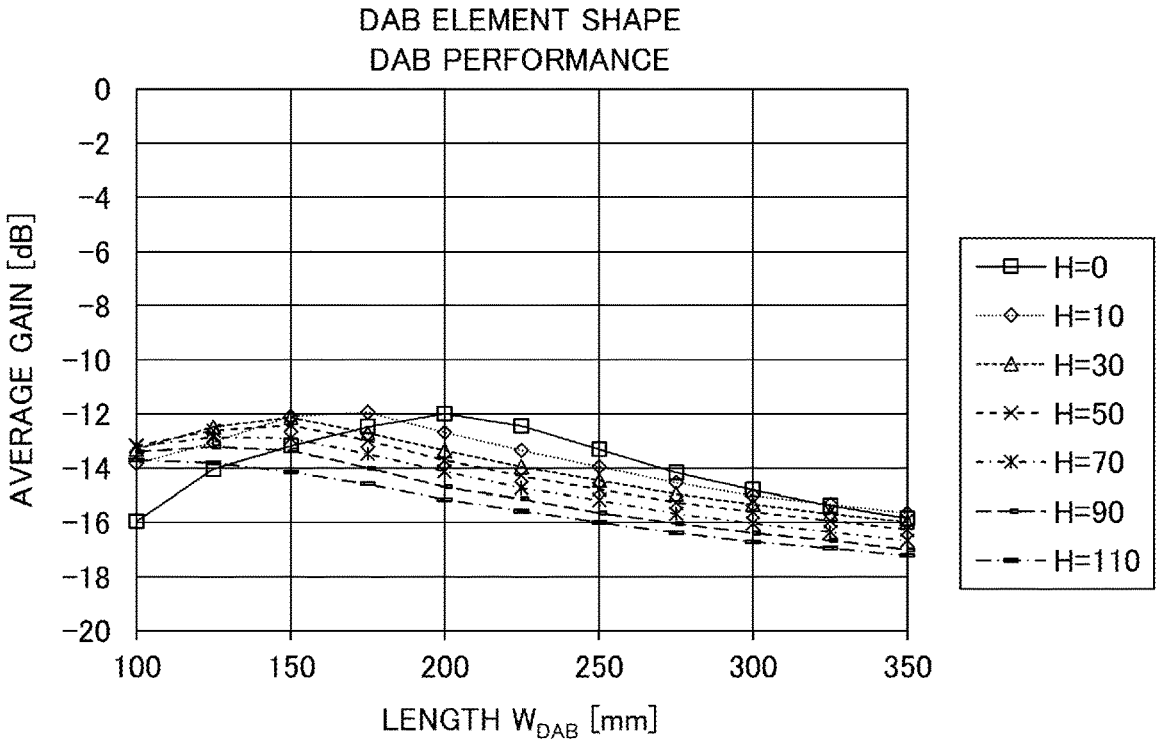
FIG. 23 is a graph showing the measurement results in FIG. 21.
FIG. 24 illustrates an example of measurement results of average antenna gains in Band III of the DAB when changing the aspect ratio of the antenna including the antenna part in FIG. 19.

FIG. 19 is a plan view illustrating an antenna part 30C contributing to reception of radio waves in Band III of the DAB in the antenna 30. Numerical values in FIG. 19 designate lengths [mm] of corresponding elements. FIG. 20 illustrates an example of measurement results of average antenna gains with respect to vertical polarization in the band of FM broadcasting waves when changing the height $H_{DAB}$ and the length $W_{DAB}$ of an antenna including the antenna part 30C. FIG. 21 illustrates an example of measurement results of average antenna gains with respect to vertical polarization in Band III of the DAB when changing the height $H_{DAB}$ and the length $W_{DAB}$ of the antenna including the antenna part 30C. FIG. 22 is a graph showing the measurement results in FIG. 20. FIG. 23 is a graph showing the measurement results in FIG. 21. Note that a height $H_{DAB}$=0 corresponds to a pattern in which no loop is provided in the antenna part 30C in FIG. 19.

According to FIGS. 20 to 23, in the case where the height $H_{DAB}$ and the length $W_{DAB}$ of the antenna part 30C were adjusted, although the average antenna gain in Band III of the DAB changed significantly, the average antenna gain in the band of FM broadcasting waves did not change significantly.

Ranges within which values greater than or equal to a threshold of "−14 dB" that enables the antenna to receive radio waves in Band III of the DAB with relatively high sensitivity, were obtained as follows:

$$110\ [\text{mm}] \geq H_{DAB} \geq 10\ [\text{mm}]$$

$$250\ [\text{mm}] \geq W_{DAB} \geq 100\ [\text{mm}]$$

Ranges within which values greater than or equal to a threshold of "−13 dB" that enables the antenna to receive radio waves in Band III of the DAB with relatively high sensitivity, were obtained as follows:

$$70\ [\text{mm}] \geq H_{DAB} \geq 10\ [\text{mm}]$$

$$225\ [\text{mm}] \geq W_{DAB} \geq 125\ [\text{mm}]$$

FIG. 24 illustrates an example of measurement results of average antenna gains in Band III of the DAB when changing the aspect ratio of the antenna 30 including the antenna part 30C. The antenna gain was greater than or equal to the threshold of "−14 dB" for aspect ratios obtained from cells patterned with dots. The antenna gain was greater than or equal to the threshold of "−13 dB" for aspect ratios obtained from cells patterned with oblique lines.

Figure 25:
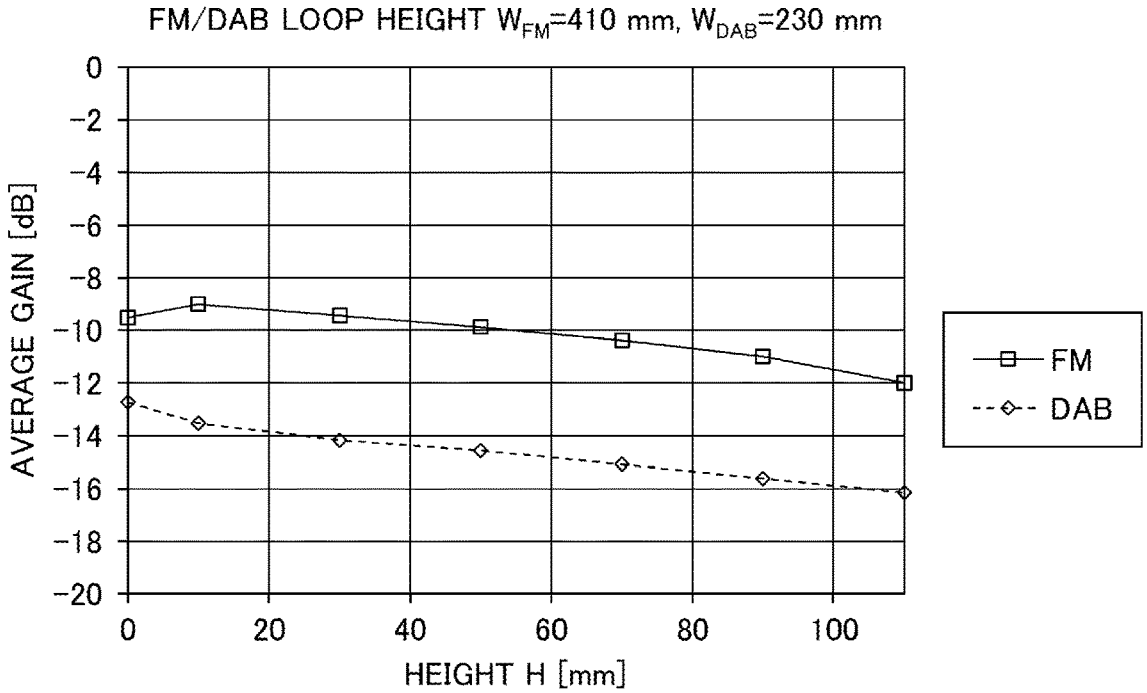
FIG. 25 illustrates an example of measurement results of average antenna gains in the band of FM broadcasting waves and in Band III of the DAB when changing the loop height of the antenna in FIG. 4.

FIG. 25 illustrates an example of measurement results of average antenna gains in the band of FM broadcasting waves and in Band III of the DAB when changing the loop height of the antenna 30 in FIG. 4. The dimensions of the respective elements during the measurement are designated in FIGS.

13 and 19. In the case where the heights of the antenna parts 30B and 30C were changed to have the same values, a smaller height exhibited a higher sensitivity.

Ranges within which values greater than or equal to the threshold of "−11 dB" that enables the antenna to receive the FM broadcasting waves with relatively high sensitivity; and values greater than or equal to the threshold of "−14 dB" that enables the antenna to receive radio waves in Band III of the DAB with relatively high sensitivity, were obtained as follows:

$$90\ [\mathrm{mm}] \geq H_{FM} \geq 0\ [\mathrm{mm}]$$

$$20\ [\mathrm{mm}] \geq H_{DAB} \geq 0\ [\mathrm{mm}]$$

Ranges within which values greater than or equal to the threshold of "−10 dB" that enables the antenna to receive the FM broadcasting waves with relatively high sensitivity; and values greater than or equal to the threshold of "−13 dB" that enables the antenna to receive radio waves in Band III of the DAB with relatively high sensitivity, were obtained as follows:

$$60\ [\mathrm{mm}] \geq H_{FM} \geq 0\ [\mathrm{mm}]$$

$$10\ [\mathrm{mm}] \geq H_{DAB} \geq 0\ [\mathrm{mm}]$$

Figure 26:
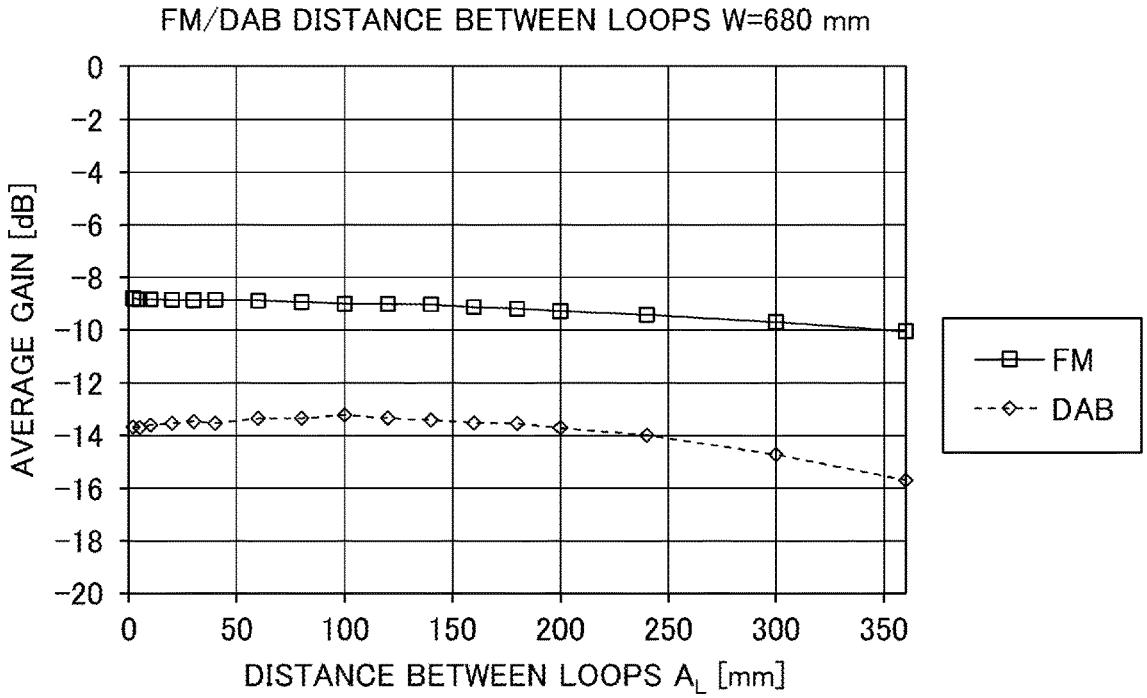
FIG. 26 illustrates an example of measurement results of average antenna gains in the band of FM broadcasting waves and in Band III of the DAB when changing the distance between the loop elements of the antenna in FIG. 4.

FIG. 26 illustrates an example of measurement results of average antenna gains in the band of FM broadcasting waves and in Band III of the DAB when changing the distance between the loop elements of the antenna 30 in FIG. 4. The dimensions of the respective elements during the measurement are designated in FIGS. 13 and 19.

A range within which values greater than or equal to the threshold of "−11 dB" that enables the antenna to receive the FM broadcasting waves with relatively high sensitivity, was obtained as follows:

$$360\ [\mathrm{mm}] \geq A_L \geq 2\ [\mathrm{mm}]$$

A range within which values greater than or equal to the threshold of "−14 dB" that enables the antenna to receive radio waves in Band III of the DAB with relatively high sensitivity, was obtained as follows:

$$240\ [\mathrm{mm}] \geq A_L \geq 2\ [\mathrm{mm}]$$

Figure 27:
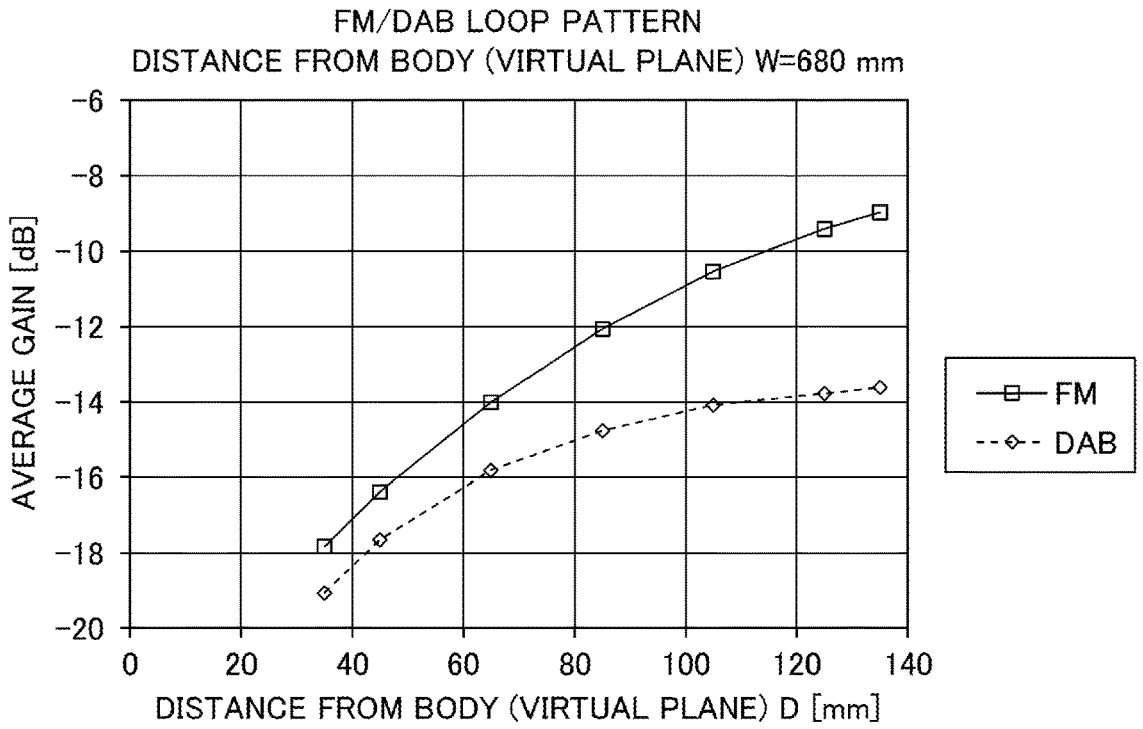
FIG. 27 illustrates an example of measurement results of average antenna gains in the band of FM broadcasting waves and in Band III of the DAB when changing the distances $D_1$ and $D_2$ from a virtual plane 12*c*.

FIG. 27 illustrates an example of measurement results of average antenna gains in the band of FM broadcasting waves and in Band III of the DAB for the antenna 30 in FIG. 4, when changing the distances $D_1$ and $D_2$ from the virtual plane 12*c*. The dimensions of the respective elements during the measurement are designated in FIGS. 13 and 19.

The average antenna gain was improved more as the distance from the virtual plane 12*c* becomes longer, both in the band of FM broadcasting waves and in Band III. In order to obtain a gain of greater than or equal to −10 dB in the band of FM broadcasting waves, it was necessary to set the distance to be longer than or equal to 90 mm. In Band III, even at a distance of longer than or equal to 80 mm, the change in the average antenna gain was small. If setting the maximum width of the spoiler 18 to 300 mm, favorable ranges can be considered as follows.

Ranges within which values greater than or equal to a threshold of "−10 dB" that enables the antenna to receive the FM broadcasting waves with relatively high sensitivity, were obtained as follows:

$$300\ [\mathrm{mm}] \geq D_1, D_2 \geq 115\ [\mathrm{mm}]$$

Ranges within which values greater than or equal to a threshold of "−11 dB" that enables the antenna to receive the FM broadcasting waves with relatively high sensitivity, were obtained as follows:

$$300\ [\mathrm{mm}] \geq D_1, D_2 \geq 95\ [\mathrm{mm}]$$

Ranges within which values greater than or equal to a threshold of "−14 dB" that enables the antenna to receive radio waves in Band III of the DAB with relatively high sensitivity, were obtained as follows:

$$300\ [\mathrm{mm}] \geq D_1, D_2 \geq 115\ [\mathrm{mm}]$$

Figure 28:
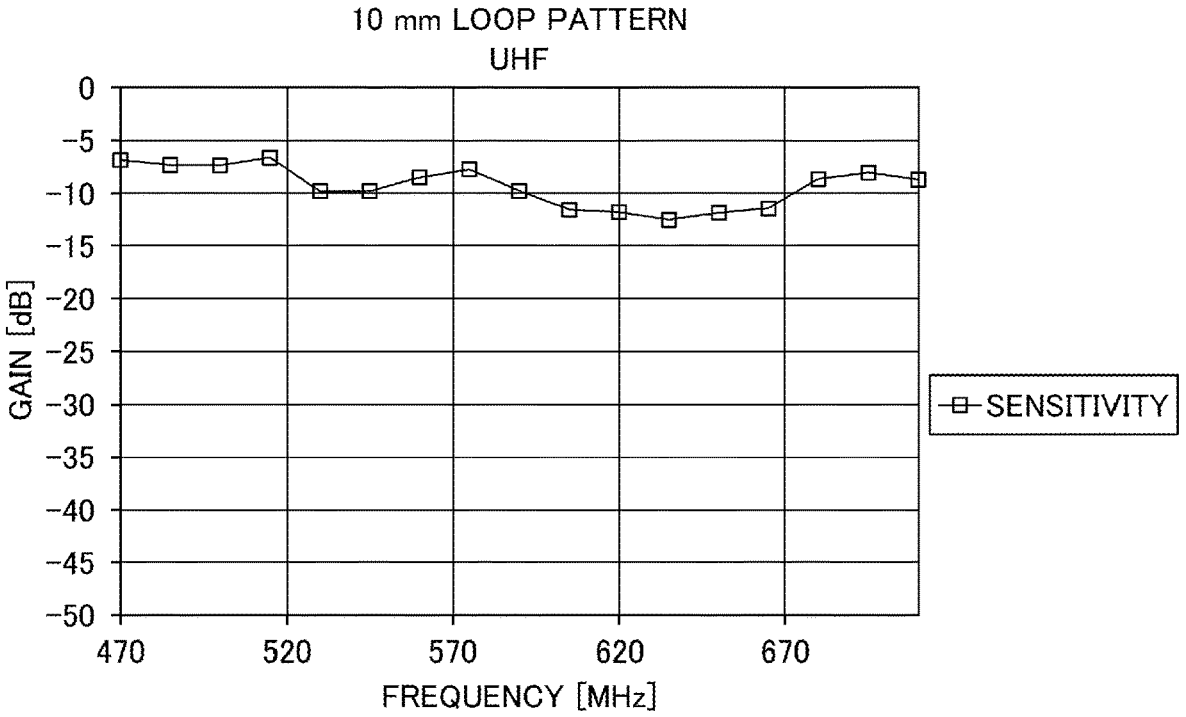
FIG. 28 illustrates an example of measurement results of average antenna gains of the antenna in FIG. 4 in the UHF band.

FIG. 28 illustrates an example of measurement results of average antenna gains of the antenna 30 in FIG. 4 in the UHF band. The dimensions of the respective elements during the measurement are designated in FIGS. 13 and 19. It was confirmed that the antenna can be used satisfactorily for reception of the UHF band. In other words, in addition to the AM broadcasting waves, the FM broadcasting waves, and the broadcasting waves of the DAB, the terrestrial digital broadcasting waves could be also received satisfactorily. Note that the band of the terrestrial digital broadcasting waves ranges from 470 MHz to 720 MHz, and every measurement result of the UHF band was an average antenna gain in horizontal polarization.

As above, the embodiment has been described; note that the techniques in the present disclosure are not limited to the embodiment described above. Various modifications and improvements can be made, such as combinations and substitutions with some or all of other embodiments.

For example, the antenna device according to the present disclosure is not limited to the case of being installed in a vehicle component made of resin; for example, as long as radio waves can be received with a desired sensitivity, the antenna device may be installed in a vehicle component made of a material other than resin.

The invention claimed is:

1. An antenna device that is installed in a vehicle component attached to a vehicle body, to receive radio waves in a first frequency band, radio waves in a second frequency band, and radio waves in a third frequency band, the antenna device comprising:

a power feeding portion;

an antenna including a first antenna portion electrically connected to the power feeding portion, and a second antenna portion electrically connected to the power feeding portion; and an amplifier electrically connected to the power feeding portion, wherein the first antenna portion comprises a first element including a part extending in a first direction, and a first loop element having a loop-shaped outer edge and being connected to an end of the first element on an opposite side with respect to the power feeding portion, wherein the second antenna portion comprises a second element including a part extending in a first direction, and a second loop element having a loop-shaped outer edge and being connected to an end of the second element on an opposite side with respect to the power feeding portion, wherein the first loop element includes a part extending in the first direction, and a part extending in a second direction that is different from the first direction, wherein the second loop element comprises a part extending in the first direction, and a part extending in a third direction opposite to the second direction, and wherein the first loop element and the second loop element are positioned apart from each other.

2. The antenna device as claimed in claim 1, wherein the first direction is a direction extending away from a metal part of the vehicle body, and wherein as viewed in a direction normal to a horizontal plane in a state where the vehicle component is attached to the vehicle body, the first element and the second element intersect an edge of the metal part.

3. The antenna device as claimed in claim 2, wherein defining a virtual plane as a plane that passes through an antenna outlet formed on a surface of the metal part, and is orthogonal to the first direction, denoting a distance from the virtual plane to an end of the first antenna portion on the first direction side by $D_1$ [mm], a distance from the virtual plane to an end of the second antenna portion on the first direction side by $D_2$ [mm], a maximum width of the first loop element in the first direction by $H_1$ [mm], a maximum width of the first loop element in the second direction by $L_1$ [mm], a maximum width of the second loop element in the first direction by $H_2$ [mm], a maximum width of the second loop element in the third direction by $L_2$ [mm], spacing between the first loop element and the second loop element by $A_L$ [mm], $L_1+A_L/2$ by $W_1$ [mm]

$L_2+A_L/2$ by $W_2$ [mm]

an antenna capacitance of the first antenna part by $C_{a1}$ [pF], an antenna capacitance of the second antenna part by $C_{a2}$ [pF], an antenna capacitance of the antenna by $C_a$ [pF], a received voltage of the first antenna part by $V_{a1}$ [dBμ$V_{emf}$], a received voltage of the second antenna part by $V_{a2}$ [dBμ$V_{emf}$], and a received voltage of the antenna by $V_a$ [dBμ$V_{emf}$], and setting $k_1=1.02\times10^{-4}$, $k_2=7.97\times10^{-5}$, $k_3=2.61\times10^{-2}$, $k_4=1.77\times10^{-2}$, $k_5=9.83\times10^{-4}$, $k_6=2.87\times10^{-1}$, $l_1=3.29\times10^{-2}$, $l_2=6.99\times10^{-2}$, and $l_3=2.76\times10^{1}$, following equations are satisfied, $$C_{a1} = (k_1 \cdot H_1 - k_2 \cdot D_1 + k_3) \cdot W_1 + k_4 \cdot H_1 + k_5 \cdot D_1 + k_6 \quad \text{[Formula 1]}$$

$$C_{a2} = (k_1 \cdot H_1 - k_2 \cdot D_1 + k_3) \cdot W_2 + k_4 \cdot H_2 + k_5 \cdot D_2 + k_6$$

$$C_a = C_{a1} + C_{a2}$$

$$V_{a1} = -l_1 \cdot H_1 + l_2 \cdot D_1 + l_3$$

$$V_{a2} = -l_1 \cdot H_2 + l_2 \cdot D_2 + l_3$$

$$V_a = 20\log_{10}\left\{\left(10^{\frac{V_{a1}}{20}} - 10^{\frac{V_{a2}}{20}}\right) \cdot \frac{C_{a1}}{C_{a1} + C_{a2}} + 10^{\frac{V_{a2}}{20}}\right\}$$

wherein denoting a voltage at an input terminal of the amplifier by $V_i$ [dBμ$V_{emf}$], and a load capacitance from the power feeding portion to the amplifier by $C_i$ [pF], a following equation is satisfied, $$V_i = 20\log_{10}\left(\frac{C_a}{C_a + C_i} \cdot 10^{\frac{V_a}{20}}\right) \quad \text{[Formula 2]}$$

and wherein the voltage $V_i$ [dBμ$V_{emf}$] satisfies following inequalities:

$$15\ [\text{dB}\mu V_{emf}] \le V_i \le 35\ [\text{dB}\mu V_{emf}]. \quad \text{[Formula 3]}$$

4. The antenna device as claimed in claim 3, further comprising:

a cable connecting the power feeding portion with the amplifier, wherein the load capacitance $C_i$ [pF] is a sum of the input capacitance $C_{AMP}$ [pF] of the amplifier and the capacitance $C_{cb}$ [pF] of the cable.

5. The antenna device as claimed in claim 2, wherein by defining a virtual plane as a plane that passes through an antenna outlet formed on a surface of the metal part, and is orthogonal to the first direction, and denoting a distance from the virtual plane to an end of the first antenna part on the first direction side by $D_1$ [mm], a distance from the virtual plane to an end of the second antenna part on the first direction side by $D_2$ [mm], a maximum width of the first loop element in the first direction by $H_1$ [mm], a maximum width of the first loop element in the second direction by $L_1$ [mm], a maximum width of the second loop element in the first direction by $H_2$ [mm], a maximum width of the second loop element in the third direction by $L_2$ [mm], spacing between the first loop element and the second loop element by $A_L$ [mm], and $L_1+L_2+A_L$ by W [mm], following inequalities are satisfied:

$50\ [\text{mm}] \le W \le 1500\ [\text{mm}]$, $10\ [\text{mm}] \le H_1 \le 300\ [\text{mm}]$, $10\ [\text{mm}] \le H_2 \le 300\ [\text{mm}]$, $15\ [\text{mm}] \le D_1 \le 300\ [\text{mm}]$, and $15\ [\text{mm}] \le D_2 \le 300\ [\text{mm}]$.

6. The antenna device as claimed in claim 2, wherein defining a virtual plane as a plane that passes through an antenna outlet formed on a surface of the metal part, and is orthogonal to the first direction, and denoting a distance from the virtual plane to an end of the first antenna portion on the first direction side by $D_1$ [mm], and a distance from the virtual plane to an end of the second antenna portion on the first direction side by $D_2$ [mm], $D_1$ is the same as $D_2$.

7. The antenna device as claimed in claim 1, wherein a maximum width $L_1$ of the first loop element in the second direction is 3.18 times or greater and 50 times or smaller with respect to a maximum width $H_1$ of the first loop element in the first direction.

8. The antenna device as claimed in claim 1, wherein a maximum width $L_2$ of the second loop element in the third direction is 0.91 times or greater and 25 times or smaller with respect to a maximum width $H_2$ of the second loop element in the first direction.

9. The antenna device as claimed in claim 1, wherein denoting a maximum width of the first loop element in the second direction by $L_1$, and denoting a maximum width of the second loop element in the second direction by $L_2$, following inequalities are satisfied:

$$250\ [mm] \leq L_1 \leq 550\ [mm], \text{ and}$$

$$100\ [mm] \leq L_2 \leq 250\ [mm].$$

10. The antenna device as claimed in claim 1, wherein denoting spacing between the first loop element and the second loop element by $A_L$ [mm], following inequalities are satisfied:

$$0\ [mm] < A_L \leq 240\ [mm].$$

11. The antenna device as claimed in claim 1, wherein the first element and the second element are connected to different connection points in the power feeding portion.

12. The antenna device as claimed in claim 1, wherein the first element and the second element are connected to a common connection point of the power feeding portion via a shared connection element.

13. The antenna device as claimed in claim 1, wherein the first direction is substantially orthogonal to the second direction and the third direction.

14. The antenna device as claimed in claim 1, wherein each of the first loop element and the second loop element has an outer edge being substantially a rectangle.

15. The antenna device as claimed in claim 1, wherein denoting spacing between the first element and the second element by A, following inequalities are satisfied:

$$0\ [mm] < A \leq 240\ [mm].$$

16. The antenna device as claimed in claim 1, wherein the first element and the first loop element have respective parts extending in the first direction on a straight line parallel to the first direction, and wherein the second element and the second loop element have respective parts extending in the first direction on a straight line parallel to the first direction.

17. The antenna device as claimed in claim 1, wherein the first frequency band is a band of AM broadcasting waves, wherein the second frequency band is a band of FM broadcasting waves, and wherein the third frequency band is a band of Band III of DAB.

18. The antenna device as claimed in claim 17, wherein the antenna device further receives radio waves in a fourth frequency band, and the fourth frequency band is a band of terrestrial digital broadcasting waves.

19. The antenna device as claimed in claim 1, wherein the vehicle component is made of resin.

20. The antenna device as claimed in claim 1, wherein the vehicle component is a spoiler.

* * * * *